US006971551B2

(12) United States Patent
Widgery

(10) Patent No.: US 6,971,551 B2
(45) Date of Patent: Dec. 6, 2005

(54) BEVERAGE TRANSPORTING AND DISPENSING SYSTEMS AND METHODS

(75) Inventor: Troy Widgery, Denver, CO (US)

(73) Assignee: Go Fast Sports and Beverage Company, Denver, CO (US)

( * ) Notice: Subject to any disclaimer, the term of this patent is extended or adjusted under 35 U.S.C. 154(b) by 124 days.

(21) Appl. No.: 10/387,035

(22) Filed: Mar. 11, 2003

(65) Prior Publication Data

US 2003/0168474 A1 Sep. 11, 2003

Related U.S. Application Data

(60) Provisional application No. 60/364,066, filed on Mar. 12, 2002, provisional application No. 60/363,608, filed on Mar. 11, 2002.

(51) Int. Cl.[7] ..... B67D 5/56

(52) U.S. Cl. ..... 222/129; 222/131; 222/143; 222/145.1; 222/145.5; 222/212

(58) Field of Search ..... 222/129, 131, 222/143, 212, 145.1, 145.3, 145.5

(56) References Cited

U.S. PATENT DOCUMENTS

| | | | |
|---|---|---|---|
| 43,154 | A | 6/1864 | Heneage |
| 59,687 | A | 11/1866 | Waldstein et al. |
| 170,073 | A | 11/1875 | Ernst |
| 180,132 | A | 7/1876 | Hoard et al. |
| 251,566 | A | 12/1881 | Fuller |
| 308,708 | A | 12/1884 | Sinclair |
| 730,337 | A | 6/1903 | Bonnefont |
| 815,883 | A | 3/1906 | Biarcom |
| 1,289,218 | A | 12/1918 | Maiden |
| 1,364,763 | A | 1/1921 | Houghton |
| 1,750,334 | A | 3/1930 | Stern |
| 1,913,460 | A | 6/1933 | Smetana |
| D100,412 | S | 7/1936 | Carp |
| 2,256,240 | A | 9/1941 | Clemons |
| 2,470,806 | A | 5/1949 | del Cueto |
| 2,780,225 | A | 2/1957 | Barr et al. |
| 3,590,989 | A | 7/1971 | Wittwer |

(Continued)

FOREIGN PATENT DOCUMENTS

WO WO 3076327 A2 * 9/2003

*Primary Examiner*—Kenneth Bomberg
(74) *Attorney, Agent, or Firm*—Townsend and Townsend and Crew LLP

(57) ABSTRACT

In one embodiment, a beverage dispensing container (100) includes a primary chamber (112, 114) for holding a first liquid and a fluid dispensing device (430) coupled to the primary chamber. The fluid dispensing device is adapted to provide access to the primary chamber when in a first position, and is adapted to fluidly seal the primary chamber when in a second position. The primary chamber further defines a cavity (110) adapted to receive a second container (130) therein. The second container holds a second liquid in a second chamber, and has a fluid port adapted to be opened to provide fluid access to the second chamber. A sealing mechanism (200) is adapted to fluidly seal the fluid port when the second container is disposed in the cavity. The sealing mechanism permits the removal of the second container from the cavity and the reinsertion of the second container into the cavity to fluidly reseal the open fluid port. In this manner, a second container, such as an energy drink container, can be opened and then stored in the sports fluid dispensing container of the present invention in a manner which reduces or eliminates spillage from the open second container.

11 Claims, 18 Drawing Sheets

U.S. PATENT DOCUMENTS 3,741,383 A 6/1973 Wittwer
3,862,704 A 1/1975 Millies et al.
3,997,092 A 12/1976 Pogwizd
3,998,351 A 12/1976 Smith et al.
4,020,981 A 5/1977 Nixdorff
4,159,769 A 7/1979 Hatten et al.
4,235,343 A 11/1980 Thompson
4,542,930 A 9/1985 Adams
4,793,501 A 12/1988 Beck
4,892,234 A 1/1990 Bennett
5,065,875 A 11/1991 Balavich
5,071,042 A 12/1991 Esposito
5,100,033 A 3/1992 Cho
5,139,182 A 8/1992 Appla
5,285,933 A 2/1994 Gentes et al.
5,316,398 A 5/1994 Chandaria et al.
5,328,063 A 7/1994 Beck et al.
5,368,156 A 11/1994 Bruzzi et al.
5,398,828 A 3/1995 Valyi
5,417,327 A 5/1995 Saumure
5,477,994 A 12/1995 Feer et al.
5,582,315 A 12/1996 Reid
5,588,550 A 12/1996 Meyer
5,603,436 A 2/1997 Leoncavallo et al.
5,743,444 A 4/1998 Beck et al.
5,758,786 A 6/1998 John
5,779,102 A 7/1998 Smith
5,810,185 A 9/1998 Groesbeck
5,881,868 A 3/1999 Soyak et al.
5,921,440 A 7/1999 Maines
5,947,324 A 9/1999 Palinchak
5,984,141 A 11/1999 Gibler
5,992,677 A 11/1999 Ebine
6,073,757 A 6/2000 Kornick et al.
6,179,146 B1 1/2001 Betras
6,263,923 B1 7/2001 Castillo
6,286,733 B1 9/2001 Francois
6,382,476 B1 5/2002 Randall et al.

* cited by examiner

Fig. 2A
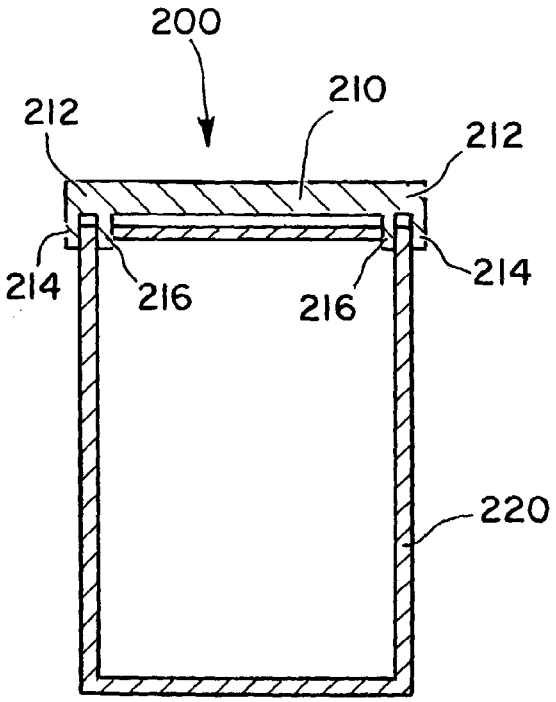
Fig. 2B
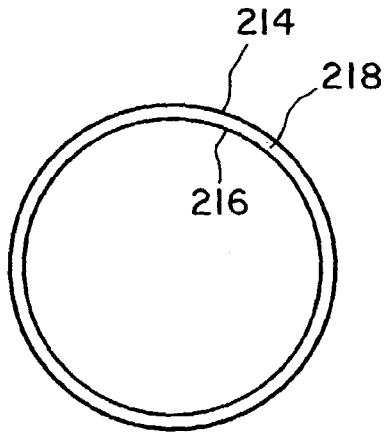
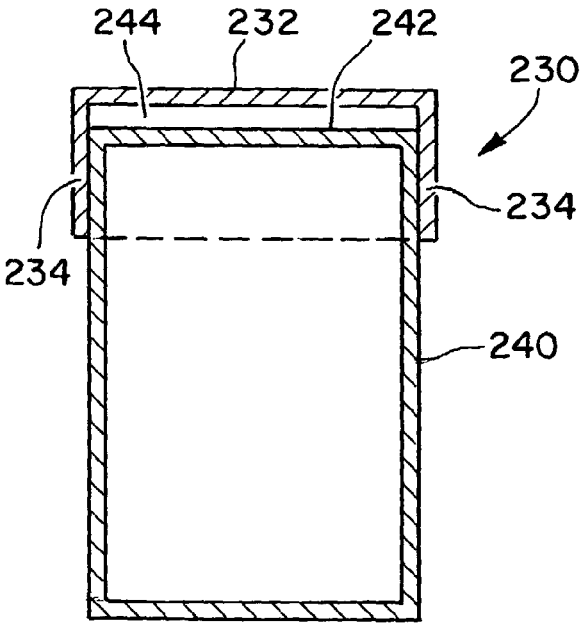
Fig. 2C
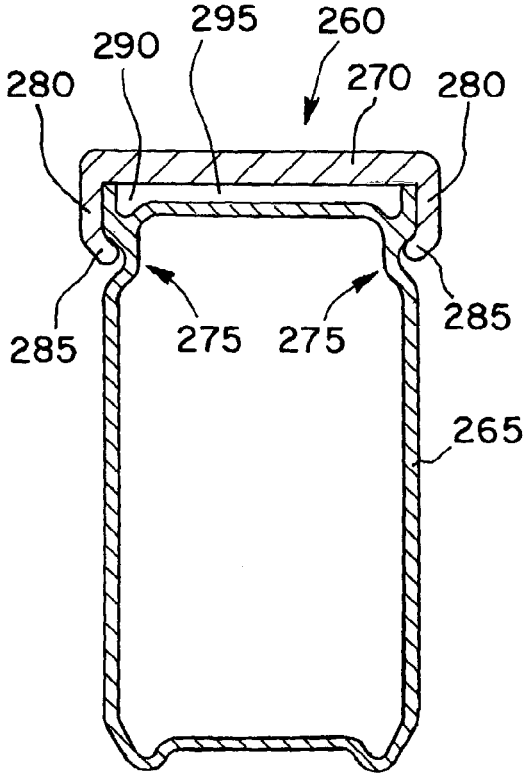
Fig. 2D

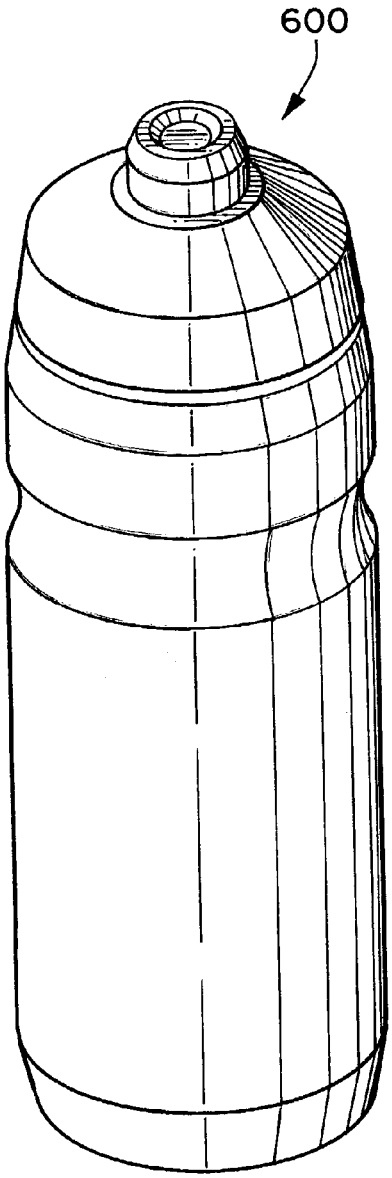
Fig. 6A
Fig. 6B
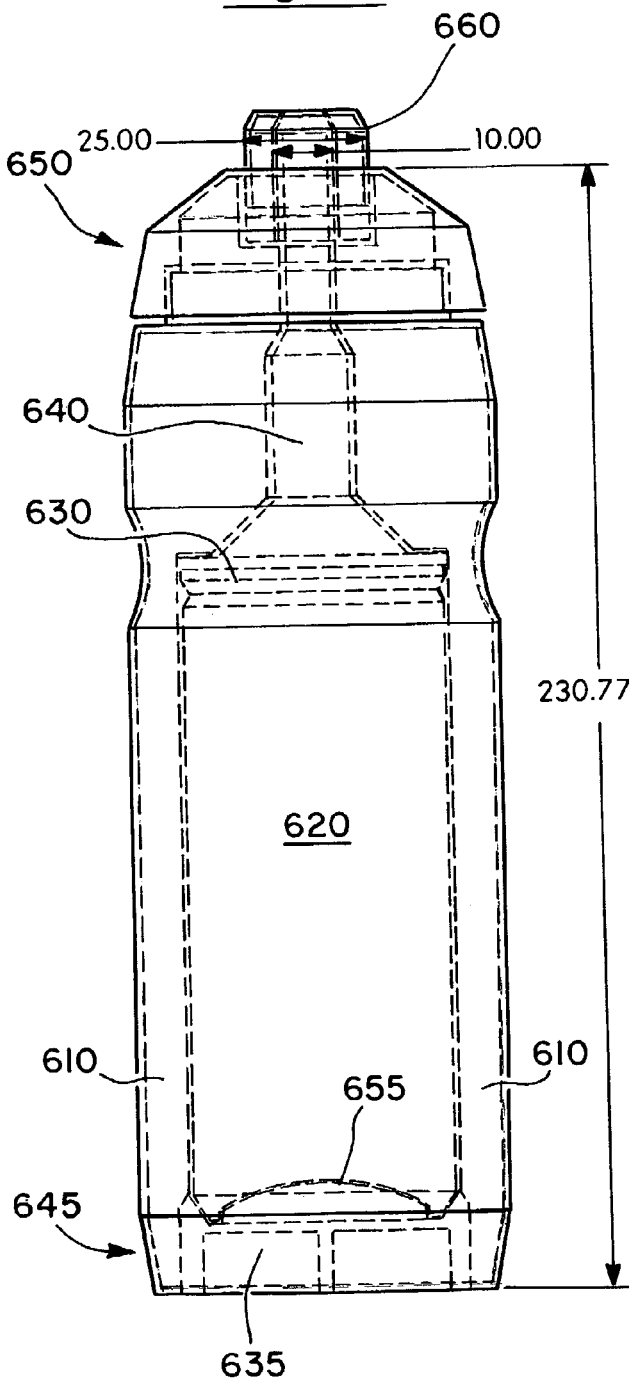

CLOSED FLOW

EDRINK FLOW

LIQUID FLOW

Fig. 11A
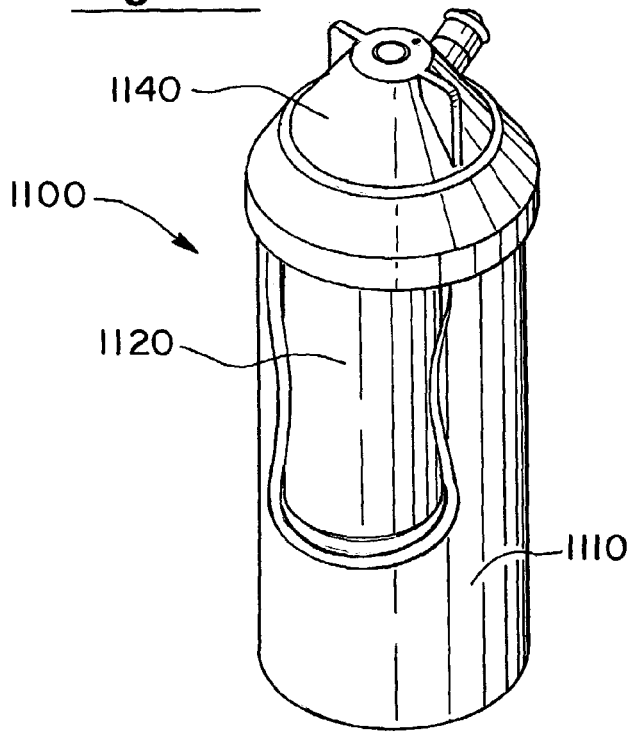
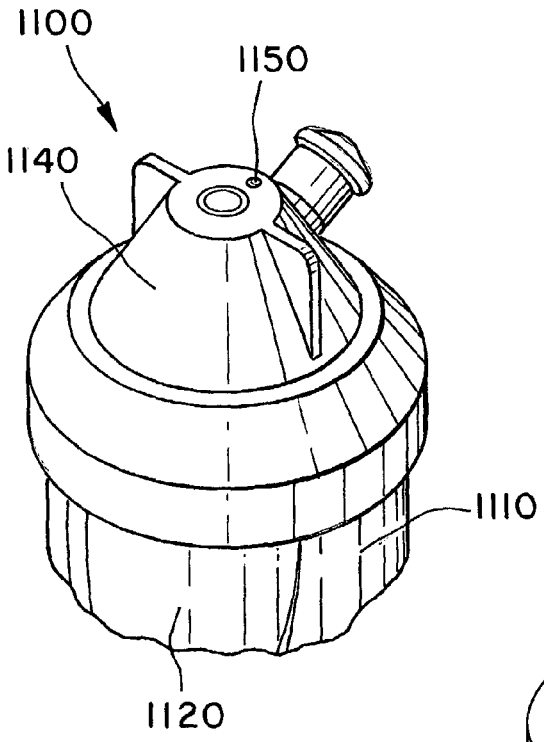
Fig. 11B
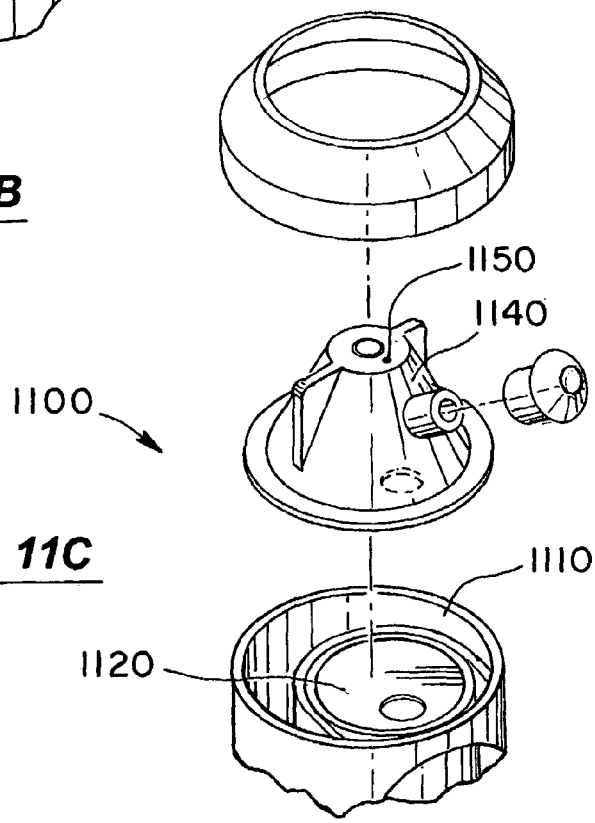
Fig. 11C

Fig. 16A
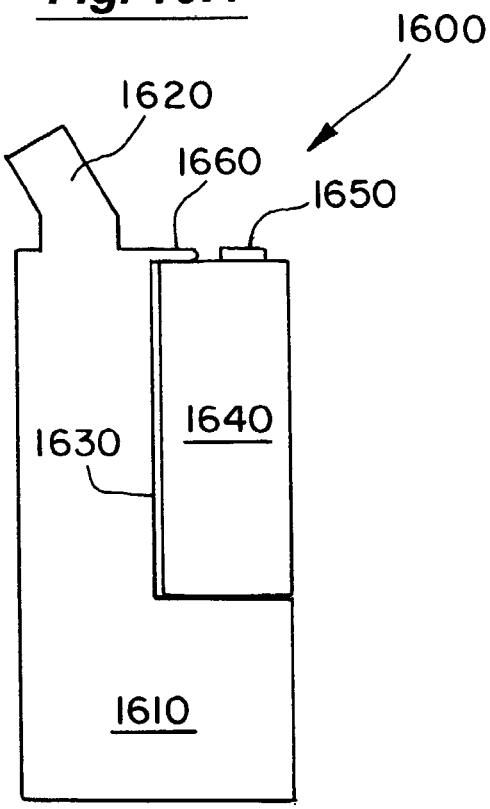
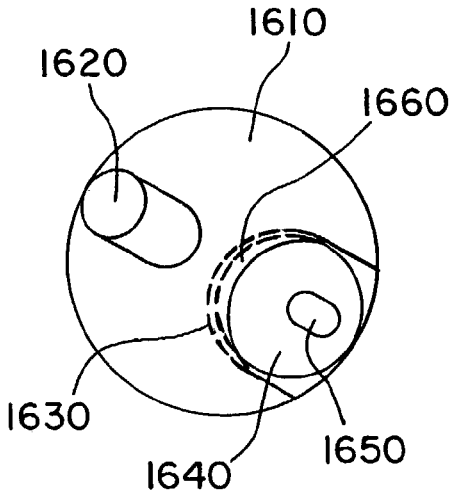
Fig. 16B
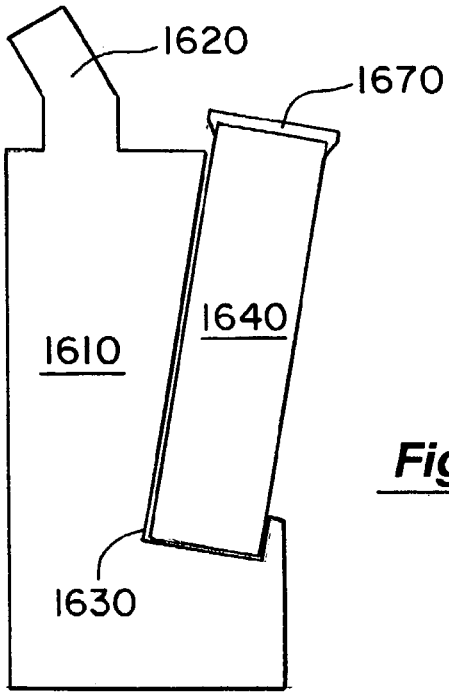
Fig. 16C

BEVERAGE TRANSPORTING AND DISPENSING SYSTEMS AND METHODS

CROSS-REFERENCES TO RELATED APPLICATIONS

The present application claims priority from U.S. Provisional Application No. 60/363,608, entitled "CONTAINER JACKET," filed Mar. 11, 2002, and from U.S. Provisional Application No. 60/364,066, entitled "CONTAINER JACKET," filed Mar. 12, 2002, the complete disclosures of which are herein incorporated by reference for all purposes.

BACKGROUND OF THE INVENTION

The present invention is directed generally to beverage systems, and more specifically, to systems and methods for dispensing water, hydrating fluids, energy drinks and other sports beverages to athletes and non-athletes alike.

A few decades ago, ordinary tap water seemed to suffice to quench the thirst of individuals exercising or involved in strenuous activity. Tap water was and remains available from health club drinking fountains, and was passed out to joggers running road races from aid stations lining the race route. Bikers would carry water bottles during their rides.

The never ending quest for increased athletic performance eventually led to a wide range of specialized products for professional, amateur and student athletes, and the weekend warrior. Bottled water from natural springs became popular as an "improved" hydrating fluid. Individuals working out at the local gym could be seen carrying around their own bottle of spring water, believing it to be superior to the ordinary tap water from the gym's drinking fountain. Specialized beverages also were developed and marketed, with an emphasis on replenishing fluids and electrolytes lost during exercise. When it wasn't being poured over winning football coaches, Gatorade® was consumed in large quantities by athletes participating in a variety of sports. As the market for hydrating and electrolyte replenishing fluids grew, more products entered the market, each touting their thirst quenching attributes.

Only in the last few years, however, has a new type of beverage appeared on the market. Falling generally under the category of "energy drinks", these beverages purport to boost the energy of consumers, and has found particular use by athletes during exercise or sports participation. Energy drinks may contain a variety of chemicals, vitamins, sugars, caffeine, and other ingredients. Two such drinks are sold under the trademarks RED BULL® and GO FAST®. These drinks often are sold in containers smaller than the typical water bottle or soda can. This unique size of container has presented a surprisingly large number of issues which need to be overcome. For example, most vending machines are designed and manufactured for dispensing beverages in twelve (12) or twenty (20) fluid ounce containers, or in half-liter containers (16.9 fluid ounces), as such are commonly used for juices, tea, soda pop, and other beverages. The vending machines typically are ill-suited for dispensing smaller containers and may become jammed if smaller containers are used. Further, cup or bottle holders found affixed to bicycles, exercise equipment, and the like, also are designed and constructed to accommodate larger beverage containers. As a result, energy drink containers placed in these larger cup and bottle holders may bounce around considerably, or possibly fall out of the holder.

Another problem with energy drinks is that while such drinks provide an energy boost to the consumer, they typically do not significantly rehydrate an athlete who is losing fluids through sweating, breathing, and the like. Energy drinks also may not provide the larger quantities of liquid preferred by some consumers. Some individuals may attempt to rehydrate and receive an energy boost by combining their energy drink with a hydrating fluid, such as water or Gatorade®, in a larger container. However, this results in a strange tasting hydrating fluid or a watered down energy drink. The distinct tastes of the energy drink and hydrating fluid are lost. Thus, it would be desirable to overcome at least some of the problems in the art.

BRIEF SUMMARY OF THE INVENTION

The present invention provides exemplary sport fluid dispensing systems and methods. Such systems and methods will be particularly useful for dispensing beverages to thirsty individuals, for facilitating the dispensing of prepackaged drinks from vending machines, and for other uses as evident and described herein.

In one embodiment of the present invention, a beverage dispensing container, which may be a sports fluid dispensing container includes a primary chamber for holding a first liquid and a fluid dispensing device coupled to the primary chamber. The fluid dispensing device is adapted to provide access to the primary chamber when in a first position, and is adapted to fluidly seal the primary chamber when in a second position. The primary chamber further defines a cavity adapted to receive a second container therein. The second container holds a second liquid in a second chamber, and has a fluid port adapted to be opened to provide fluid access to the second chamber. A sealing mechanism is adapted to fluidly seal the fluid port when the second container is disposed in the cavity. The sealing mechanism is further adapted to permit removal of the second container from the cavity and reinsertion of the second container into the cavity to fluidly reseal the open fluid port. In this manner, a second container, such as an energy drink container, may be opened and then stored in the sports fluid dispensing container of the present invention in a manner which reduces or eliminates spillage from the open second container.

In one aspect, the primary chamber is larger than the second chamber. This may occur, for example, when the primary chamber is designed to hold water or other hydrating fluids and the second container is designed to hold an energy drink.

In one aspect, the beverage dispensing container further includes a retainer to retain the second container in the cavity. When the second container is disposed in the cavity, the retainer may engage an upper rim, a side surface and/or an end surface of the second container to help retain the second container in the cavity. In another aspect, the sealing mechanism is further adapted to securely hold the second container relative to the cavity. This may occur in conjunction with the retainer, or separate from the retainer.

In a particular aspect, the second container is a generally cylindrical container adapted to hold between about 8.2 fluid ounces and about 8.5 fluid ounces of the second liquid. The second container may include, for example, standard energy drink containers holding 8.3 fluid ounces (246 milliliters (ml)) or 8.4 fluid ounces (250 ml). Other size and shape of second containers also are anticipated within the scope of the present invention. In one embodiment, the second liquid comprises an energy drink, such as drinks commercially available under the names Go Fast®, Red Bull®, KMX®, Sobe® Adrenaline Rush, and the like. Similarly, in one embodiment, the first liquid comprises a hydrating fluid, such as water, Gatorade®, Accelerade®, Powerade®, and the like.

In one embodiment, the sealing mechanism comprises a lip adapted to fit around an upper edge of the second container, and a cap portion extending from the lip and adapted to be disposed over the second container upper surface which contains the fluid port. In this manner, the sealing mechanism operates to fluidly seal the upper surface portion of the second container so that fluid leakage from the second container is reduced or eliminated.

In another aspect, the sealing mechanism is coupled to a second fluid dispensing device for dispensing the second liquid. In this manner, both the first and second liquids are dispensed through dispensing devices while the second container is disposed in the cavity.

In one embodiment, the primary container further includes an inner extension which extends into the cavity when an outer surface of the primary container is compressed. In this manner, and assuming the second container is disposed in the cavity, the inner extension is adapted to at least partially compress the second container when the outer surface of the primary container is compressed. In one aspect, the inner extension comprises an inner surface of the primary container. This may occur, for example, in the embodiment in which the primary container comprises a plastic and the second container comprises a metal.

In one aspect, the fluid dispensing device is further coupled to the sealing mechanism so that the second liquid is selectively dispensed through the fluid dispensing device when the fluid dispensing device is positioned in a third position. Thus, the user may selectively dispense the first or second liquid of their choosing, or seal the dispensing container so that neither fluid is presently dispensed. In other embodiments, described more fully below, selectable amounts of the first and second fluids are simultaneously dispensed.

In some aspects, at least a portion of the fluid dispensing device is adapted to move relative to the primary chamber to be positioned in the first, second and third positions. Alternatively, the fluid dispensing device further includes a fluid port that is adapted to be positioned in the first, second and third positions. The movement or positioning of fluid dispensing device and/or fluid port may involve translating, sliding, rotating, twisting, pushing, pulling, or some combination of these movements, or the like. These and alternative cap and dispensing arrangements are further detailed below.

While the primary chamber defines or helps define the cavity, the cavity may be accessed in several different ways. For example, in one aspect, the second container is inserted through an opening in a side of the primary container to be disposed in the cavity. Alternatively, the second container is inserted through an opening in a bottom of the primary container to be disposed in the cavity. In still another aspect, the opening is in a top of the primary container.

In another embodiment, a sports fluid dispensing system includes a primary chamber for holding a first liquid, with the primary chamber defining a cavity therein. A second container is adapted to be disposed in the cavity. The second container holds a second liquid in a second chamber, with the second container having a fluid port adapted to be opened to provide fluid access to the second chamber. A sealing mechanism is positioned near an end of the cavity and is adapted to receive at least a portion of the second container having the fluid port when the second container is disposed in the cavity. A fluid dispensing device is coupled to the primary chamber and to the sealing mechanism, with the fluid dispensing device being adapted to provide selectable access to the primary chamber and the second chamber. In a particular embodiment, the sealing mechanism is adapted to permit removal of the second container from the cavity and reinsertion of the second container into the cavity to fluidly reseal the open fluid port.

In one aspect, the sealing mechanism includes a generally ring-shaped lip adapted to fit around at least a portion of an upper rim of the second container. In another aspect, the sealing mechanism includes a resilient member, such as an O-ring, adapted to engage a portion of the second container. In one aspect, the beverage dispensing system further includes a biasing member adapted to engage the second container and bias the second container towards the sealing mechanism. The biasing member may consist of a wide range of items, including but not limited to a spring, a tension device, a resilient member made from foam, rubber and a number of other flexible materials having a shape memory. The biasing member may comprise a separate component coupled to a desired location within the cavity, or may be integrally formed with the primary chamber.

In one embodiment, a beverage container according to the present invention includes a primary chamber having an outer surface compatible for being dispensed by a vending machine. The primary chamber further defines a cavity adapted to receive a second container therein, with the second container holding a liquid in a second chamber and having a fluid port adapted to be opened to provide fluid access to the second chamber. The container includes a retainer adapted to secure the second container in the cavity.

In one aspect, the primary chamber is further adapted for holding a beverage and has a dispensing device coupled thereto for dispensing the beverage. In another aspect, the primary chamber has an opening into the cavity for receiving the second container, with this opening disposed in a side or an end of the primary chamber, or in both. In one aspect, the retainer restricts at least a portion of the opening. In another aspect, the retainer includes an inner surface of the primary chamber. In still another aspect, the retainer is a releasable pressure fit of second container in the cavity. The pressure fit may involve a side-to-side pressure fit on second container, an end-to-end pressure fit, or the like. The beverage container also may include a sealing mechanism, which permits removal and reinsertion of the second container into the cavity to fluidly reseal the open fluid port.

The present invention further includes methods of dispensing one or more liquids. In one embodiment, such a method includes providing a beverage dispensing container as detailed herein, opening the second container, inserting the second container into the cavity so that the sealing mechanism fluidly seals a portion of the second container having the fluid port, and dispensing the first liquid from the fluid dispensing device.

In one aspect, the second container is removed from the sealing mechanism and the cavity, the second liquid is dispensed from the second chamber through the fluid port, and the second container is reinserted into the cavity to be resealed by the sealing mechanism. Alternatively, the fluid dispensing device is further coupled to the sealing mechanism so that the first and/or second liquids may be selectively dispensed through the fluid dispensing device.

The summary provides only a general outline of some of the embodiments according to the present invention. Many other objects, features and advantages of the present invention will become more fully apparent from the following detailed description, the appended claims and the accompanying drawings.

BRIEF DESCRIPTION OF THE DRAWINGS

FIGS. 2A, 2C and 2D are cross-sectional views of sealing mechanisms according to the present invention;

FIG. 2B is a simplified bottom view of the sealing mechanism shown in FIG. 2A;

FIG. 6A is an overall view of a beverage dispensing system according to an embodiment of the present invention;

FIG. 6B is a cross-sectional view of the beverage dispensing system shown in FIG. 6A;

FIGS. 10A, 11A, and 12A are simplified overall views of alternative embodiments of beverage dispensing devices according to the present invention;

FIGS. 10B, 11B and 12B are simplified overall views of the fluid dispensing portion of the embodiments shown in FIGS. 10A, 11A, and 12A, respectively;

FIGS. 10C, 11C, and 12C are simplified exploded views of the fluid dispensing portion of the systems shown in FIGS. 10B, 11B, and 12B, respectively;

FIGS. 16A–16C are simplified views of another embodiment of the present invention.

DETAILED DESCRIPTION OF THE INVENTION

Figure 1A:
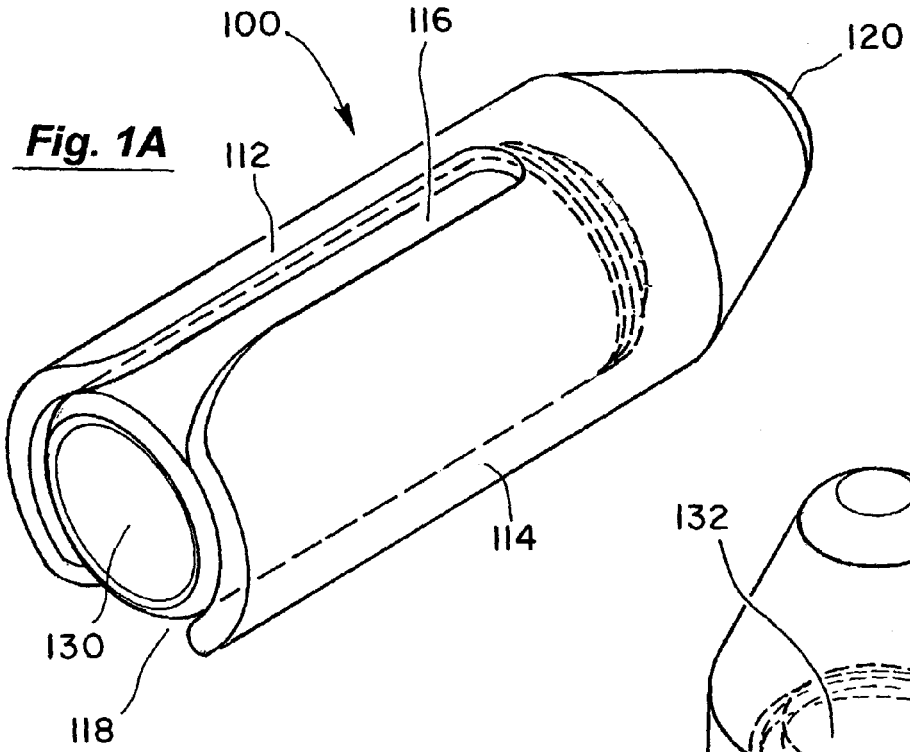
FIGS. 1A–1E are overall views of containers according to the present invention.
Figure 1D:
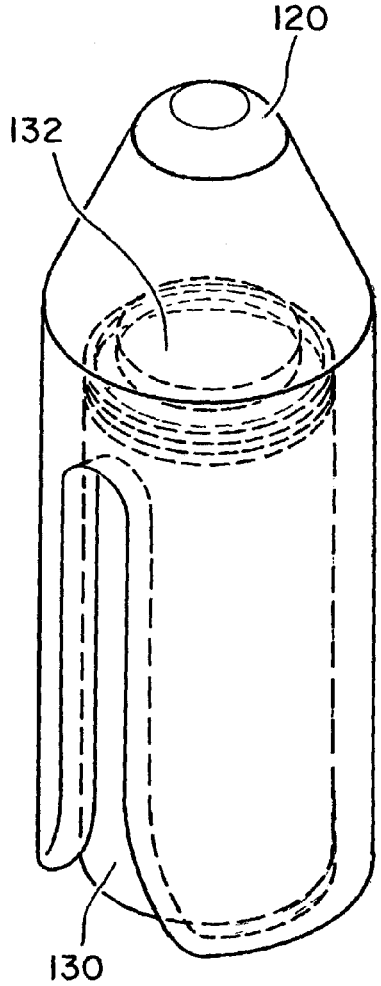
Figure 1C:
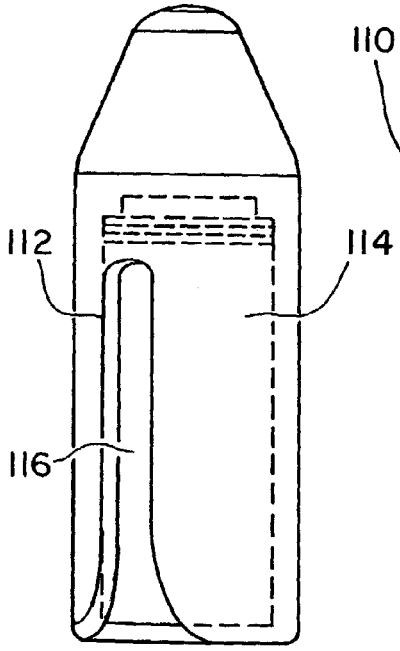

Turning to FIGS. 1A–1D, an exemplary sports fluid container 100 according to the present invention will be described. Sports fluid container 100 will be particularly useful for facilitating the dispensing of small beverage containers from standard vending machines which typically dispense only larger beverage containers. In one embodiment, containers 100 will be useful for dispensing an energy drink container as further described below.

Sports fluid container 100 includes first and second opposing halves 112 and 114 having a common upper portion but otherwise separated from each other by gaps 116 and 118. Halves 112 and 114 together define a cavity 110 therebetween. Gaps 116, 118 help facilitate the receipt of a drink container 130 into cavity 110. In one embodiment, halves 112, 114 are stretched or separated slightly to facilitate the insertion of drink container 130 into cavity 110. In a particular embodiment, drink container 130 is an energy drink container. In one embodiment, container 130 comprises a metal can adapted to hold about 8.3 or about 8.4 fluid ounces of liquid. In another embodiment, container 130 is adapted to contain between about 8.2 fluid ounces and about 8.5 fluid ounces. Container 100 further includes an optional cap 120 as shown in FIGS. 1A–1D. Cap 120 may comprise a separate piece, which snaps onto halves 112 and 114, or alternatively is formed as a uniform piece in conjunction with halves 112 and 114.

When container 130 is disposed in cavity 110, container 100 has the general dimensions, and in some cases weight, of a standard beverage container dispensable from a vending machine. For example, container 100 and container 130 together may have a similar weight and/or dimension as a container holding twelve (12) or twenty (20) ounces, or a half-liter of beverage, or the like, although are not limited to these standard sizes. In this manner, container 100 may be used in a vending machine to "trick" the vending machine into perceiving that the product in the machine is designed for that machine. As a result, beverages in the smaller container 130 may be dispensed from vending machines or other dispensing equipment designed for larger products.

Sports fluid container 100 may comprise a wide range of materials, including, plastic, foam, rubber, glass, metals, and the like. In a particular embodiment, container 100 comprises plastic and may be formed through a variety of molding or other manufacturing techniques known to those skilled in the art. For example, container 100 may be constructed using an injection mold, a blow mold, a rotational mold, and the like.

In a particular embodiment, halves 112 and 114 are hollow structures adapted to hold a liquid. For example, halves 112 and 114 may contain water, or other hydrating fluids for use by the purchaser. In this embodiment, cap 120 may have a fluid dispensing port (not shown in FIGS. 1A–1D) so that the individual can drink or pour the beverage from container 100. In another embodiment, cap 120 is a removable cap which in turn reveals the fluid chamber(s) in halves 112, 114, and/or reveals a dispensing port coupled to the chambers so that the fluid contained in halves 112 and 114 may be accessed. Halves 112 and 114 may be fluidly coupled to define a single fluid chamber, or may define two or more separate chambers.

Figure 1B:
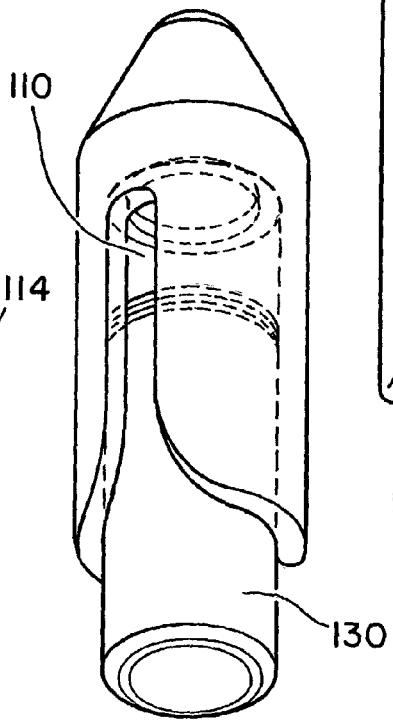

FIG. 1B depicts container 130 being inserted into cavity 110 through a bottom opening. Alternative points of entry into cavity 110 also fall within the scope of the present invention. For example, one or both of gaps 116 and 118 may be large enough to accommodate the insertion of container 130 therethrough, so that container 130 is recessed in cavity 110. In another embodiment, gaps 116 and 118, in the relaxed state, are not wide enough to fit around container 130. In this case, however, halves 112 and 114 may comprise a material of sufficient flexibility so that second container 130 is squeezed through gap 116 and/or gap 118 to be received in cavity 110.

Figure 1E:
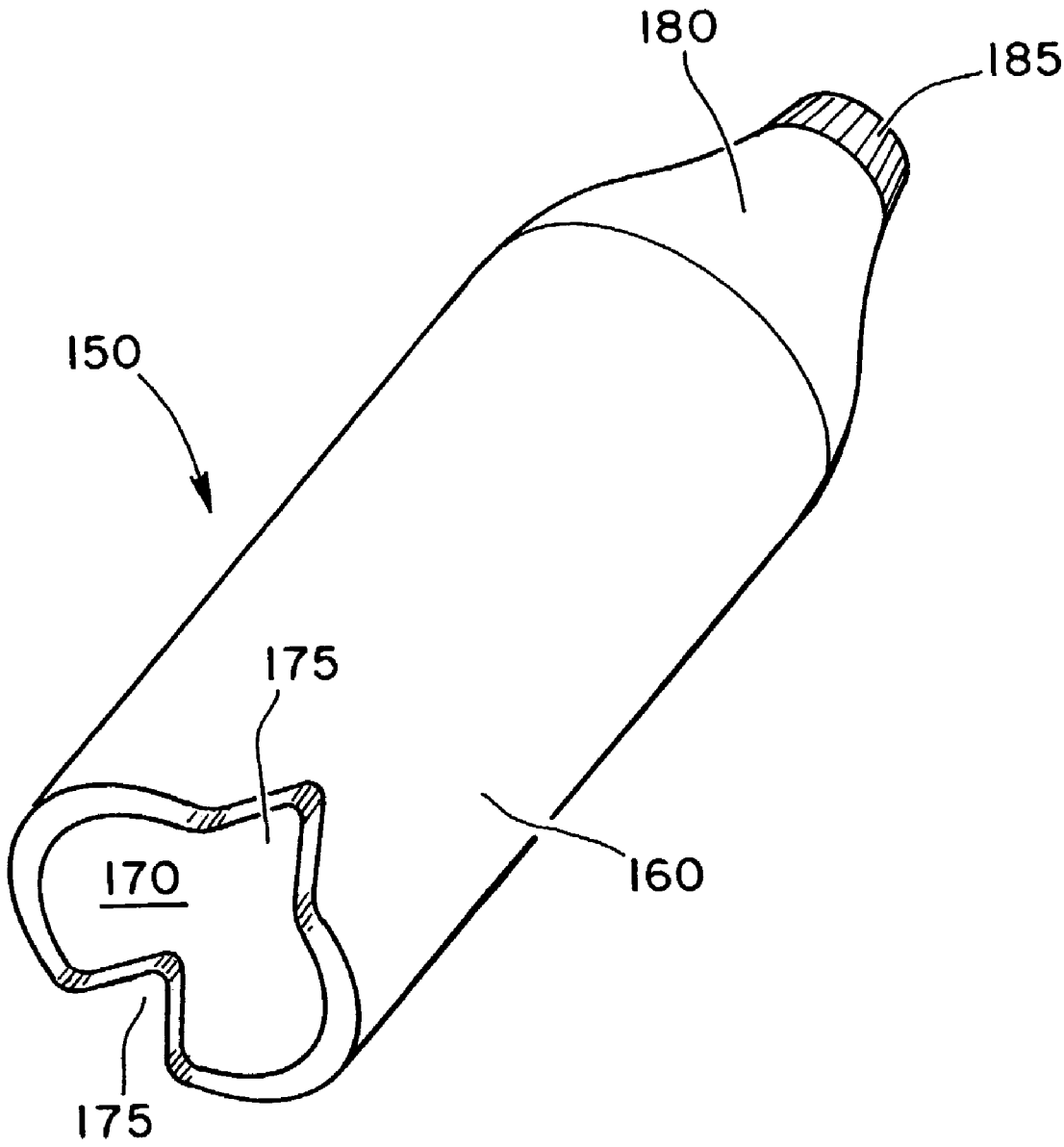

FIG. 1E depicts an alternative embodiment of a beverage container 150 according to the present invention having a cavity 170 formed therein. This configuration is similar to that shown in FIGS. 1A–1D, except container 150 has a single sleeve 160, instead of having halves 112, 114 partially or fully separated by gaps 116, 118. Sleeve 160 may be a two walled sleeve with a space defined therebetween. In this case, the inner sleeve wall helps define the size of cavity 170. The outer sleeve wall may be of sufficient size to permit handling or vending of container 150 from vending equipment or machines. In one embodiment, the walls of sleeve 160 form a second cavity, which may be filled with air or a liquid as described in conjunction with FIGS. 1A–1D.

Cavity 170 is adapted to slidably receive a second container 130 (not shown). In one embodiment, second container 130 is maintained within cavity 170 by a pressure fit. For example, second container 130 may contact the inner surface of cavity 170 such that the constrictive nature of primary container 160 holds second container 130 therein. In one embodiment, the pressure fit of second container 130 is an end-to-end pressure fit. Alternatively, a side-to-side pressure fit is experienced by second container 130.

Second container 130 may be withdrawn from cavity 170 in several different ways. For example, in one embodiment as shown, one or more cutouts 175 allow a user to slip one or more fingers or thumbs in cutouts 175 and grasp a lower end of second container 130. The user then pulls second container 130 from cavity 170. In another embodiment, the pressure fit maintains second container 130 within cavity 170, but a shaking motion of container 150 results in second container 130 being expelled from cavity 170. While two generally triangular-shaped cutouts 175 are shown, the number, shape and position of cutouts 175 may vary within the scope of the present invention. For example, cutouts 175 may have a round or other shape, and there may be more or less than the two cutouts shown in FIG. 1E. In one embodiment, container 150 includes a cap portion 180, which may have a fluid dispensing port 185. In one aspect, container 150 also has a similar appearance, shape, and weight as a standard container known to those skilled in the art, including, half-liter containers, twenty ounce containers, and the like.

Further, container 150 may be vendable from standard vending machines due in part to its dimensions and weight. Container 150 may be used for second containers 130 having various dimensions. For example, energy drinks often come in two standard sizes, which may have an identical or nearly identical dimension but vary slightly in length. The embodiment shown in FIG. 1E is adapted to accommodate both such containers, as well as others.

Removal of second container 130 from container 100 may be as simple as grabbing exposed opposing surfaces of container 130 and pulling container 130 out of container 100. Alternatively, squeezing container 100 with the force applied along gaps 116 and 118, may cause halves 112 and 114 to separate a sufficient amount, permitting container 130 to be withdrawn or drop from cavity 110. In this manner, container 100 provides a temporary storage device for beverage container 130, which in some cases facilitates the dispensing thereof from standard vending equipment. Other uses of container 100 may be realized. For example, the size of container 100 may permit its use in cup and bottle holders found on sports or athletic equipment. In this embodiment, the user can take along smaller container 130, without the concern that container 130 will fall from a too-large cup holder or will be unnecessarily jostled or banged around, or the like.

Turning now to FIGS. 2A–2D, alternative embodiments of the present invention will be described. While currently sold in approximately eight (8) to nine (9) ounce quantities, the consumer may not want to drink the entire can of energy drink or other beverage in one sitting. For example, if an individual is on a bicycle ride, they may desire to take periodic sips of the energy drink or beverage so that the drink gives an actual or perceived "boost" of energy during the ride. However, the energy drink cans or containers typically have standard pull-top or push-top openings which, once opened, remain open. It will be appreciate by those skilled in the art that once a can is opened, jostling or tilting of the can may cause the remaining beverage to spill out. Thus, as shown in FIGS. 2A–2D, the present invention includes several systems and methods for at least temporarily sealing the top of an open container. It will be appreciated by those skilled in the art that the scope of the present invention exceeds the examples of sealing mechanisms discussed below, and that other sealing mechanisms also fall within the scope of the present invention.

For example, FIG. 2A depicts a sealing mechanism 200 according to an embodiment of the present invention for sealing a top of an open beverage container 220. Sealing mechanism 200 includes a lip portion 212 having a cap portion 210 extending therebetween. In one embodiment, lip portion 212 is generally ring-shaped, and thus designed to accommodate generally cylindrical beverage containers. Lip portion 212 has an outer lip 214 and an inner lip 216. As can be seen in FIG. 2A, inner lip 216 is adapted to reside on the inside of an upper edge or rim of beverage container 220, and outer lip 214 is adapted to fit on the outside the upper edge or rim of beverage container 220. The upper rim of beverage container 220 is thus securely disposed between lips 214 and 216. Cap portion 210 extends over and above the upper surface of container 200, which typically contains an opening or fluid port from which the beverage in container 220 is dispensed. Preferably, sealing mechanism 200 is impermeable to fluids, such as water, other hydrating fluids, soft drinks, energy drinks, or the like. In this manner, applying sealing mechanism 200 to the top of an open container 220 prevents unwanted leakage from container 220.

Another embodiment of a sealing mechanism 260 according to the present invention is shown in conjunction with FIG. 2D. In this embodiment, sealing mechanism 260 includes a cap portion 270 having an outer lip 280. Outer lip 280 has a tip extension 285. This embodiment may be particularly useful for engaging the upper rim or edge of a second container 265 having the configuration similar to or as depicted in FIG. 2D. For example, the upper surface of container 265 has a cavity 290 around the outer perimeter thereof. Typically, cavity 290 provides a channel for fluid overflow from container 265. Further, the upper portion of container 265 may define an indent 275. As shown in FIG. 2D, tip extension(s) 285 engage indent 275. In one embodiment, tip extension(s) 285 grasp indent 275 with sufficient strength to provide a fluidic seal around the top of container 265. In another embodiment, tip extension(s) 285 grasp indent 275 with sufficient strength to act as a retaining device, retaining container 265 within primary chambers of other embodiments of the present invention.

In the embodiment shown in FIG. 2C, a sealing mechanism 230 includes a cap portion 232 which is placed over an upper surface 242 of container 240. Cap portion 232 is coupled to an extended lip portion 234. Lip 234 extends outside the upper rim or lip of beverage container 240, and extends down the sides of container 240 a greater distance than does outer lip 214 of FIG. 2A. Again, in one embodiment, sealing mechanism 230 comprises a resilient, flexible material which is adapted to fit snugly around container 240. In this manner, a fluid seal is created between extended lip 234 and the outer surface of container 240. In some embodiments, a gap 244 is maintained above upper surface 242 of container 240, and/or above the upper surface of container 220. Alternatively, cap portion 232 is pressed down to upper surface 242, eliminating gap 244. In the event gap 244 exists, fluid which may exit container 240 through an open fluid port (not shown) in upper surface 242. The fluid port may comprise a standard "pull top" found on most pop cans today, or some other port that is permanently or selectively opened to gain access to the fluid in container 240. Provided container 240 is maintained in an upright position, the expelled fluid will typically remain on upper surface 242 of container 240. In this manner, the fluid may resettle into the open fluid port and back into container 240, without spilling down the sides of container 240.

While the embodiments described in conjunction with FIGS. 2A–2D stand on their own, such embodiments also may be used in conjunction with the embodiments described in FIGS. 1A–1D. For example, sealing mechanisms 200 or 230 may be formed near the upper portion of halves 212 and 214. The upper edge or lip of beverage container 130 is then received in sealing mechanism 200 or 230 as described above. In this manner, container 100 is used not only to vend beverage container 130, but also may be used as a sealing mechanism so that the contents of beverage container 130 can be consumed at the user's leisure with a reduced likelihood that the contents of beverage container 130 are spilled. Further, the embodiments of FIGS. 2A–2D may be used to seal or hold a bottom edge or lip of container 130.

Figure 3A:
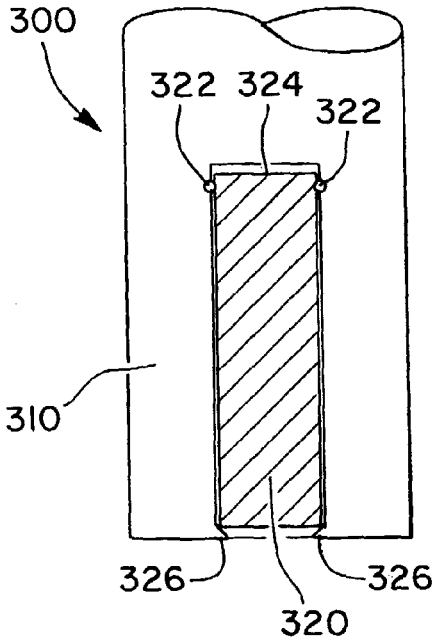
FIGS. 3A–3C are simplified front views of beverage dispensing systems according to the present invention.

Turning now to FIGS. 3A–3F, alternative embodiments of sports fluid dispensing containers will be described. FIG. 3A depicts a fluid dispensing container 300 having a primary chamber 310 defining a cavity 312. Cavity 312 is adapted to receive a second container 320. In one embodiment, second container 320 is an energy drink container, although is not limited to such. Second container 320 is inserted into cavity 312 by sliding, snapping, pressing, or the like, until an upper surface 324 of second container 320 extends above an O-ring 322 positioned near the top of cavity 312. As shown in FIG. 3A, O-ring 322 may be at least partially set into the inner edge of primary chamber 310. In this manner, O-ring 322 will remain with primary chamber 310 when second container 320 is removed. O-ring 322 operates to prevent fluid from leaking from cavity 312 when an open second container 320 is disposed therein. Preferably, O-ring 322 comprises a rubber or other resilient material having sufficient durometer and compressibility characteristics to permit its compression when second container 320 is inserted or extracted from cavity 312, while maintaining a snug fit around the upper outer surface of second container 320. In this manner, a fluid seal is maintained between the inner edge of primary chamber 310 and the outer surface of second container 320. While depicted in FIG. 3A near the top of cavity 312, O-ring 322 may be positioned elsewhere to provide a fluid seal, including on upper surface 324 of second container 320.

In one embodiment, primary chamber 310 further includes one or more extensions 326 disposed near the bottom of cavity 312. Extensions 326 may comprise small individual extensions spaced about the circumference of the bottom of cavity 312. Alternatively, extensions 326 comprise a ring extension 326 which extends around a portion or the entire circumference of cavity 312. In this manner, extension(s) 326 help maintain second container 320 within cavity 312.

Figure 3E:
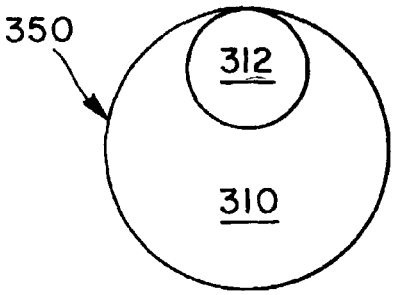
FIGS. 3E and 3F are simplified bottom views for the embodiments shown in FIGS. 3A–3C.
Figure 3F:
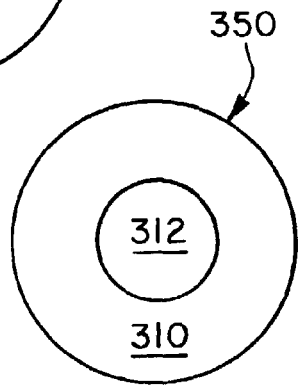
Figure 3C:
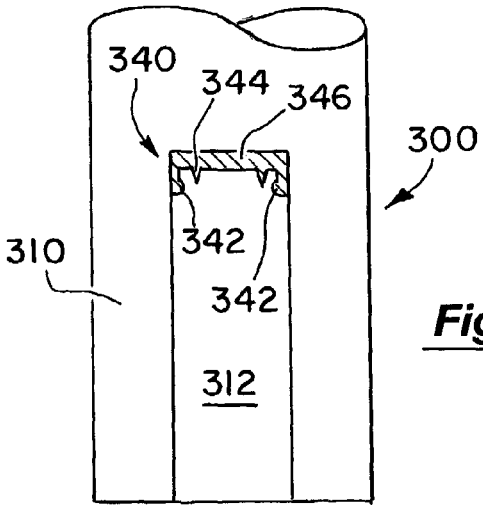
Figure 3B:
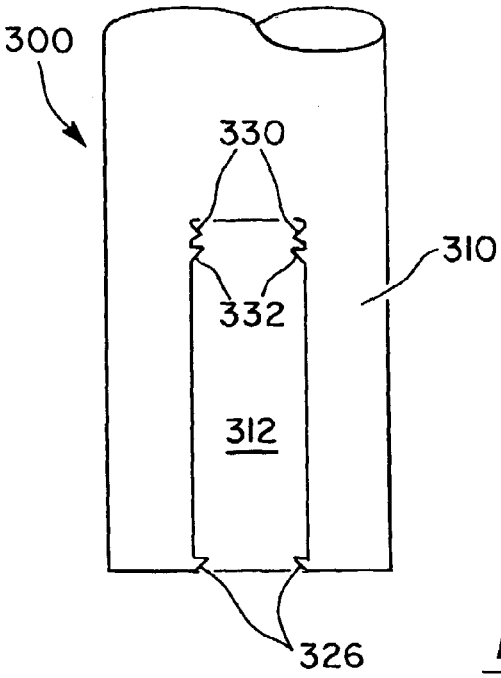
Figure 3D:
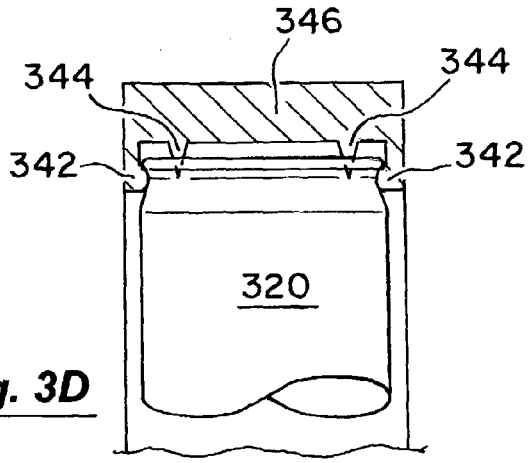
FIG. 3D is a simplified close-up view of the sealing mechanism embodiment shown in FIG. 3C.

An alternative but similar embodiment is shown in FIG. 3B. In this embodiment, O-ring 322 is replaced with an upper ridge 330 and a lower ridge 332. Upper ridge 330 is adapted to reside above an upper lip or surface 324 of second container 320, while lower ridge 332 is adapted to contact the outer surface of second container 320 near the top of container 320. In this manner, the upper edge or rim of container 320 is disposed between the upper and lower ridges 330, 332. As with O-rings 322, upper and lower ridges 330 and 332 may comprise rubber or other resilient materials adapted to at least slightly compress when second container 320 is inserted or extracted from cavity 312. Alternatively, upper and/or lower ridges 330, 332 may comprise a plastic, or a material similar or identical to that used for primary chamber 320. In one embodiment, extensions 326 as described in conjunction with FIG. 3A are included to help further maintain second container 320 in cavity 312.

Turning now to FIG. 3C, an alternative embodiment of a sports fluid dispensing device 300 according to the present invention will be described. As with the embodiments shown in FIGS. 3A and 3B, the dispensing device of FIG. 3C comprises a primary chamber 310 having a cavity 312 defined therein. Cavity 312 is again adapted to receive a second container 312 containing, in one embodiment, a sports fluid or energy drink. A sealing mechanism 340, disposed near a top of cavity 312, comprises a lower lip 342 adapted to press against the outer surface of second container 320 when container 320 is disposed in cavity 312. Lower lip 342 defines a space or gap thereabove which receives the upper rim or edge of second container 320. In this embodiment, sealing mechanism 340 further includes one or more spikes 344 which are adapted to fit in a channel or groove typically found in the upper surface 324 of most beverage containers. While shown as pointed spike 344, spikes 344 may have a variety of other shapes. Further, spikes 344 again may comprise a ring-shaped spike 344 having a similar diameter as the channel or groove in upper surface 324.

In one embodiment, a cap portion 346 is disposed over second container upper surface 324. Cap portion 346 may comprise one or more materials which are impermeable to fluids. In this manner, cap portion 346 helps fluidly seal an open second container 320. In another embodiment, cap portion 346 is permeable to air, so that second container 320 may vent carbonated gases or the like through cap portion 346. In another embodiment, a channel or other mechanism (not shown) is coupled to cap portion 346 to help vent gases to the outer atmosphere from cap portion 346. In the particular embodiment shown in FIG. 3C, and more particularly in FIG. 3D, sealing mechanism 340 sufficiently seals upper surface 324 and holds container 320 within cavity 312. In an alternative embodiment, extensions 326 also are used to help hold container 320 in cavity 312, as previously described in conjunction with FIGS. 3A and 3B.

FIGS. 3E and 3F are simplified bottom views of the embodiments shown in FIGS. 3A–3C. For example, cavity 312 may be a centrally located cavity 312 relative to primary chamber 310. In this embodiment, second container 320 is inserted into an opening centrally located in the bottom of primary chamber 310 (FIG. 3F). Alternatively, as shown in FIG. 3E, cavity 312 maybe located closer to, or adjacent a periphery 350 of primary chamber 310. In this embodiment, access to cavity 312 may occur by inserting second container 320 into an opening in the bottom of primary chamber 310. Alternatively, cavity 312 is accessible through the side of primary chamber 310, similar to that described in conjunction with FIGS. 1A–1D.

It will be appreciated by those skilled in the art that the embodiments described in FIGS. 3A–3D also may be used in conjunction with the embodiments described in FIGS. 1A–1D, as well as embodiments to be described hereafter. For example, use of sealing or retaining mechanisms allow second container 320 to be maintained in a primary container that can be vended, and may be adapted to work with second containers 320 having different heights or other dimensions.

Figure 4C:
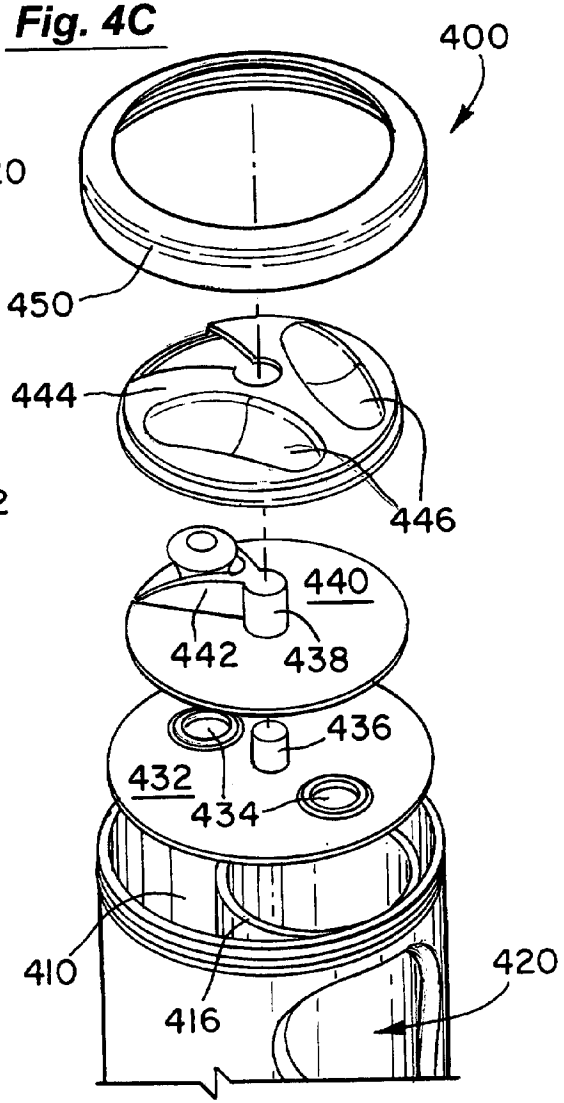
FIGS. 4B and 4C are a side view and an exploded view, respectively, of the system shown in FIG. 4A.
Figure 4B:
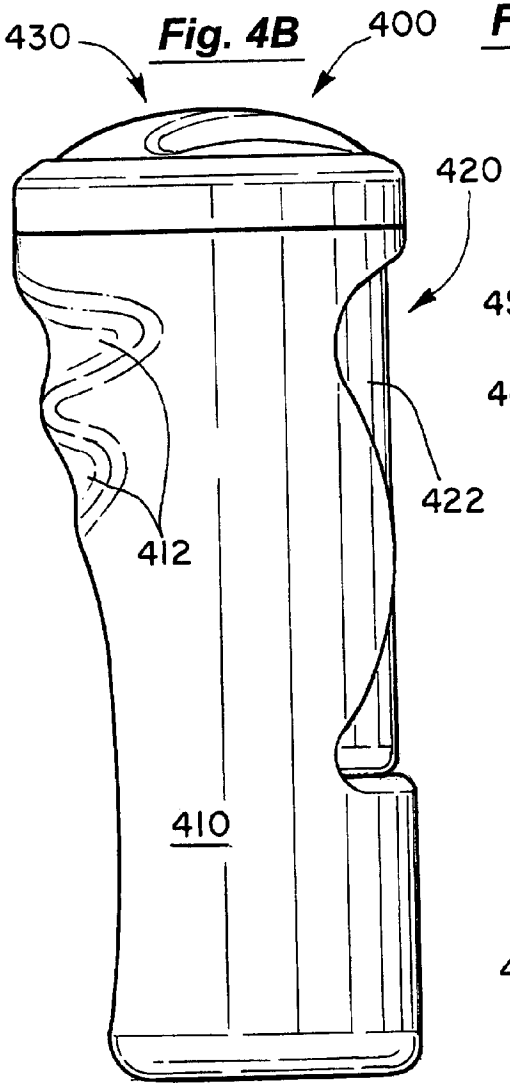
Figure 4A:
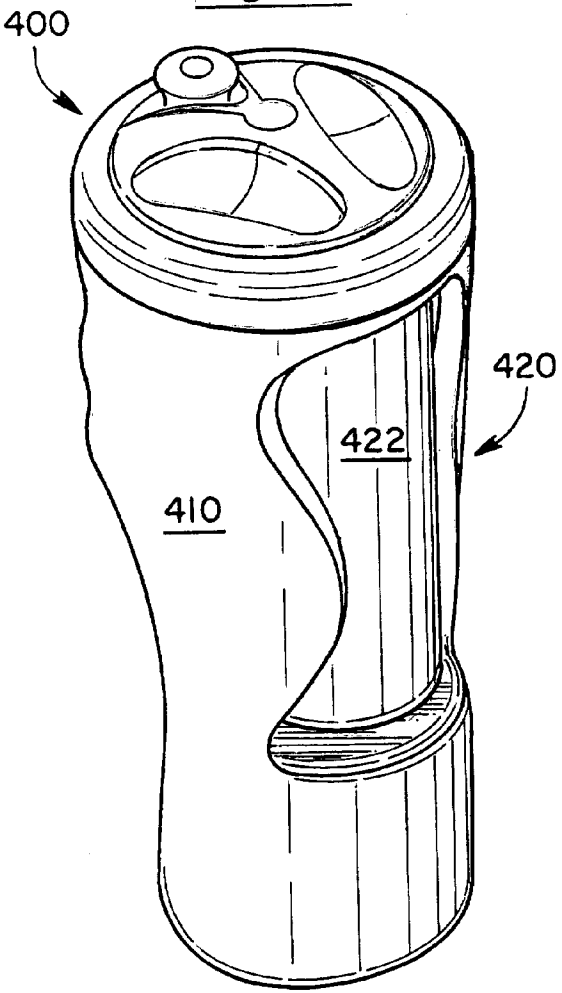
FIG. 4A is an overall view of a beverage dispensing system according to an embodiment of the present invention.

Turning now to FIGS. 4A–4C, a sports fluid dispensing system 400 according to the present invention will be described. Sports fluid dispensing system 400 includes a primary container or chamber 410 having a cavity 420 formed therein. The outer surface of primary chamber 410 may have one or more indents 412 to facilitate ease of use of system 400. For example, indents 412 are adapted to receive a user's fingers when system 400 is lifted, or carried. Preferably, cavity 420 is adapted to receive a second container 422, such as an energy drink container. In one embodiment, energy drink container 422 is opened prior to being inserted into cavity 420. Second container 422 is adapted to be received in a sleeve 416 as best shown in FIG. 4C. In one embodiment, sleeve 416 is similar to or identical to sealing mechanism 230 shown in FIG. 2C, with cap portion 232 omitted. In this embodiment, sleeve 416 forms a snug seal around the outer, upper surface of second container 422.

As can be seen in FIG. 4C, both primary chamber 410 and sleeve 416 have exposed upper portions. In this manner, two beverages or fluids may be separately contained inside system 400. Further, system 400 provides a mechanism for dispensing 430 one or both of the fluids contained in primary chamber 410 and second container 422. As shown in FIG. 4C, a lower plate 432 is disposed over the upper surface of primary chamber 410 and sleeve 416. Lower plate 432 has first and second fluid ports 434 passing therethrough, and a central knob 436. Central knob 436 is received in a recess 438 of an upper plate 440. In one embodiment, lower plate is nestled inside and held in place against the inner edge of primary chamber 410. In another embodiment, lower plate 432 is held in place by an upper ring 450 as further described below.

Upper plate 440 is rotatably coupled to lower plate 432 by receiving central knob 436 within recess 438. Upper plate further includes a primary fluid port 442, which may be rotatably aligned with first and second fluid ports 434. Primary fluid port 442 is bordered by a V-shaped raised member which extends from the upper surface of upper plate 440. In one embodiment, fluid port 442 comprises a two position fluid port, whereby the first position is a closed position and the second position is an open position. Such a fluid port 442 may be similar to those typically used with water bottles, as is known to those skilled in the art.

System 400 further includes a turn dial 444 positioned over upper plate 440. As seen in FIGS. 4A and 4C, primary fluid port 442 extends through an opening in turn dial 444. Recess 438 also is received in a central opening in turn dial 444. In one embodiment, the upper surface of recess 438 lies flush with the upper surface of turn dial 444 when the two are coupled together. Turn dial 444 further includes, in one embodiment, one or more indentations 446 to facilitate ease of use. Finally, a ring 450 is disposed around an outer edge of turn dial 444. In a particular embodiment, ring 450 has a threaded inner surface adapted to mate with a threaded outer surface of primary container 410 as can be seen in FIG. 4C. Ring 450, once firmly affixed to primary container 410 threads, helps maintain the proper alignment of turn dial 444, upper plate 440 and lower plate 432.

One or more liquids contained in primary chamber 410 and/or second container 422 may be selectively dispensed. If needed, the user rotates turn dial 444 relative to ring 450. This rotation causes upper plate 440 to rotate relative to lower plate 432. Upper plate 440 rotates to align primary fluid port 442 with a desired one of fluid ports 434. For example, upper plate 440 and turn dial 444 rotate together, while lower plate 432 and ring 450 remain stationary relative to primary container 410 and second container 422. Once primary fluid port 442 and the desired port 434 are aligned, the user extends or opens primary fluid port 442 so that fluid travels therethrough when system 400 is squeezed, turned upside down, both squeezed and turned upside down, and the like. Thus, by aligning primary fluid port 442 over the left most port 434 show in FIG. 4C, the user will have access to fluid contained in primary chamber 410. Similarly, the user can access fluid contained in second container 422 by turning dial 444, which turns upper plate 440, so that primary fluid port 442 is aligned over the right most fluid port 434. In this manner, system 400 allows the user to selectively dispense the fluid contained in primary chamber 410 and/or second container 422. This may be desirable, for example, in the event the user wants to drink a hydrating fluid at one point in time, and an energy drink or other fluid at a second point in time.

It will be appreciated by those skilled in the art that primary fluid port 442 may be opened first and then rotated into proper alignment with fluid ports 434. Further, the primary fluid port 442 may already be aligned with the desired fluid port 434. In this case, opening primary fluid port 442 will provide fluid access to primary chamber 410 or second container 422. As with prior embodiments, system 400 may comprise a wide range of materials, including, plastics, glass, polyethylenes, polypropelynes, and the like.

Figure 5A:
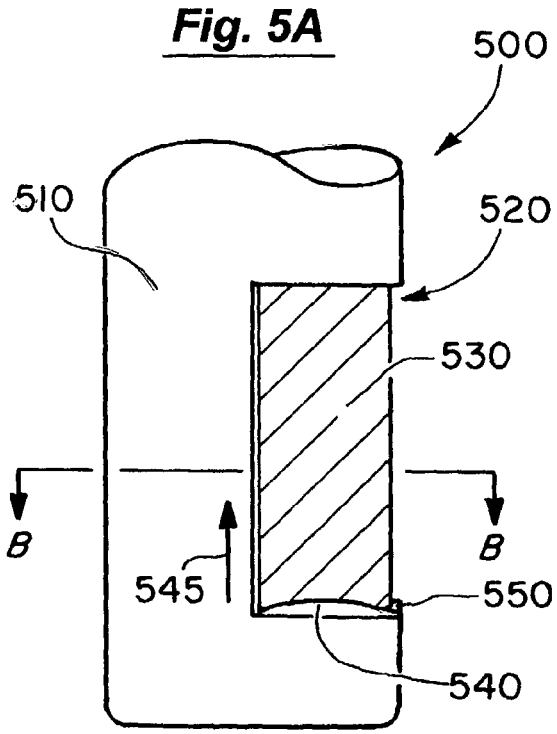
FIG. 5A is a simplified side view of an alternative beverage dispensing system according to the present invention.
Figure 5B:
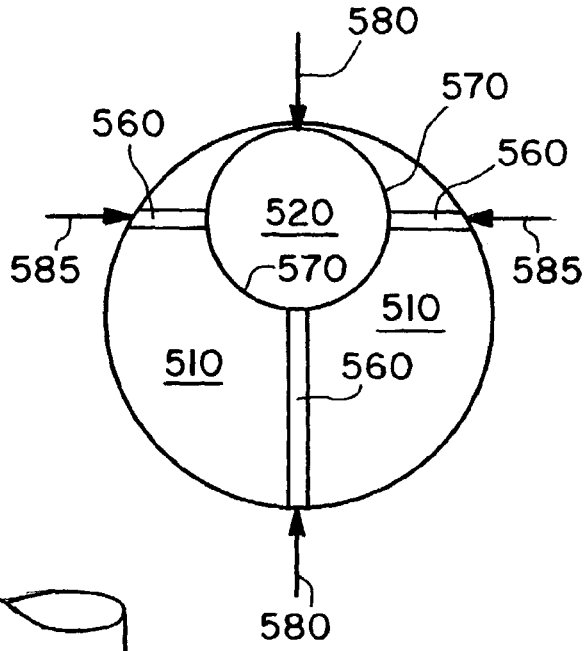
FIG. 5B is a simplified cross-sectional view taken along line B—B in FIG. 5A.
Figure 5C:
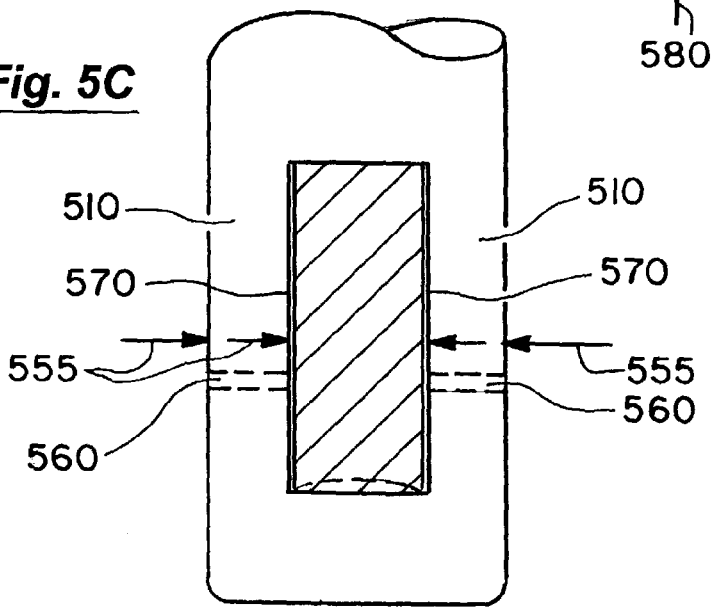
FIG. 5C is a front view of the embodiment shown in FIG. 5A.

FIGS. 5A–5C depict an alternative embodiment of a sport fluid dispensing device 500 according to the present invention. Device 500 again includes a primary chamber 510 having a cavity 520 formed therein. Cavity 520 is of sufficient size and dimension so as to be adapted to receive a second fluid container 530. Device 500 further includes a biasing member 540 depicted at the bottom of cavity 520. Biasing member 540 is adapted to bias or pressure second container 530 in the direction shown by arrow 545. In this manner, biasing member 540 helps force second container 530 toward a sealing mechanism (not shown), such as sealing mechanisms depicted in FIGS. 3A–3D or in other embodiments described herein.

Biasing member 540 may comprise a wide range of materials and structures. For example, biasing member 540 may comprise a spring, pad or block of material formed from metals, plastics, rubbers, other resilient materials having a shape memory, and the like. In a particular one embodiment, biasing member 540 is a rubber or other compressible material which is depressed by the bottom of second container 530 when container 530 is inserted into cavity 520. Once second container 530 is positioned in cavity 520, biasing member 540 presses against the bottom of container 530 to force container 530 in the direction shown by arrow 545. Biasing member 540 may comprise a separate component coupled to primary chamber 510 at a desired location within cavity 520, or may be integrally formed with primary chamber 510.

In one embodiment, biasing member 540 has a convex shape as depicted in FIG. 5A. This may be useful, for example, to mate with a concave undersurface of a second container 530. In this manner, biasing member 540 not only forces second container 530 in the direction shown by arrow 545, but nestles within the concave bottom portion of second container 530, thereby providing a more secure hold on second container 530 within cavity 520. In one embodiment, device 500 includes a knob 550 as can be seen in FIG. 5A. Knob 550 may comprise a lip over which second container 530 is pressed. Knob or lip 550 then contacts the outer surface of second container 530 to help maintain the container within cavity 520. While FIG. 5A depicts knob 550 as a single knob, knob 550 may comprise a plurality of spaced apart knobs about the opening of cavity 520. Further, knob 550 may comprise a ring or arc-shaped member spanning all or a portion of the bottom edge of cavity 520, to again help maintain second container 530 therein.

System 500 may further include a sealing mechanism to fluidly seal an opened fluid port on second container 530, and a fluid dispensing device adapted for dispensing a fluid from primary chamber 510 and/or second container 530. Sealing mechanisms and fluid dispensing devices may be used as described herein. In this instance, it may be desirable to provide a compressive force on second container 530 to help encourage the fluid or beverage contained therein out an opening in the top of second container 530. Arrows 555 show a compressive force on the outer surface of primary container 510.

In some embodiments, the structure, shape and/or materials of primary chamber 510 are sufficiently rigid to transfer the compressive force to an inner wall 570 of the primary container. This inner wall 570 helps define the surface of cavity 520. This transfer of forces to inner wall 570 may occur, for example, if primary chamber 510 has sufficient rigidity. As a result, inner wall 570 will be forced at least partially into cavity 520 to apply a pressure to second container 530. Alternatively, compressive forces shown by arrows 555 may be transferred to second container 530 in the event primary chamber 510 is full or partially full fluid, is fluidly sealed, or the like.

In other embodiments, however, compressive forces on primary container 510 may not transfer sufficient compressive forces to second container 530 absent some additional structure or mechanism. Thus, in one embodiment of the present invention, one or more extension members 560 are provided which extend to an inner-wall 570 of primary chamber 510. In one embodiment, extensions 560 define a more rigid structure than a fluid-filled primary container 510. This may occur, for example, by having extensions 560 comprise a solid piece of plastic or other material. In one embodiment, extensions 560 are spaced about primary chamber 510, such as is depicted in FIG. 5B. In this manner, applying the inward pressure as shown by arrows 585 will force at least one extension 560 inward towards cavity 520. In the event second container 530 is disposed within cavity 520, extensions 560 may extend at least partway into cavity 520 and result in a compressive force on second container 530. Alternatively, as shown in FIG. 5B, the compression of primary chamber 510 in the direction shown by arrows 585 will result in inner wall 570 being compressed into cavity 520. A compressive force thus is exerted on second container 530 contained within cavity 520.

In the embodiments shown in FIGS. 5A–5C, cavity 520 is offset from the central axis of device 500 such that at least a portion of cavity 520 is aligned or generally aligned with an outer wall of primary chamber 510. Thus, in one embodiment, compressive forces may be exerted on container 530 by applying an inward pressure directly on container 530 as shown by arrows 580. The compressive force is maintained on second container 530, in one embodiment, by having an opposing extension 560 shown near the bottom of FIG. 5B provide support or rigid structure against which second container 530 is compressed. In this manner, compressive forces applied to the outer surface of primary container 510 are transferred or at least partially transferred to second container 530 so that fluids from one or both containers may be expelled.

Figure 6C:
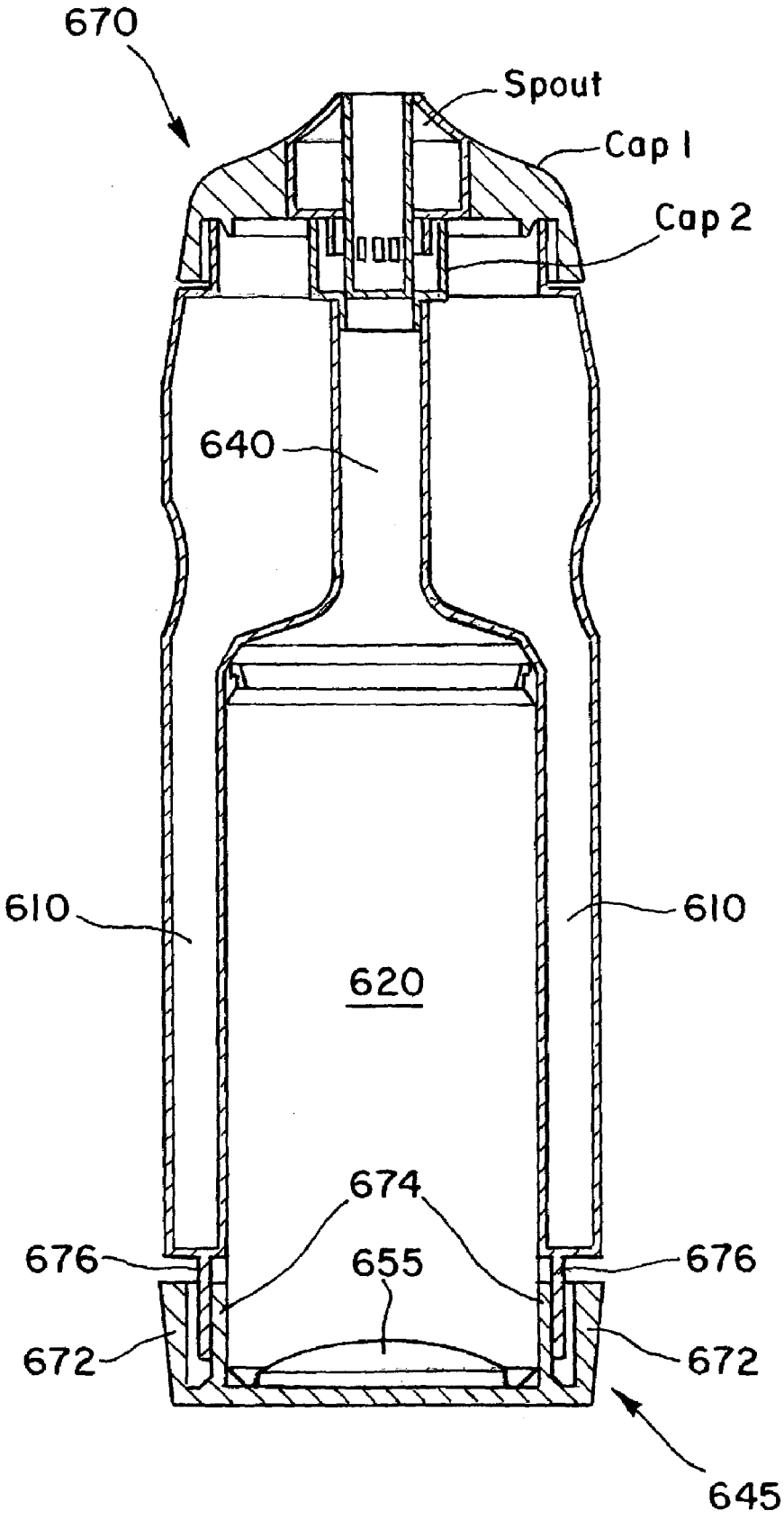
FIG. 6C is a cross-sectional view of an alternative embodiment similar to that depicted in FIGS. 6A–6B.

FIGS. 6A–6C depict an alternative embodiment of a fluid dispensing system 600 according to the present invention. System 600 again includes a primary chamber or container 610 having a cavity disposed therein adapted to receive a second container 620. Again, in one embodiment second container 620 is an energy drink container as previously described. System 600 further includes a sealing mechanism 630 adapted to at least partially envelope an upper surface of second container 620, particularly in the event the upper surface of container 620 has a fluid port for accessing fluid contained therein. Sealing mechanism may comprise or be similar to the mechanisms described in conjunction with FIGS. 2A–3D, among others. Sealing mechanism 630 is coupled to a channel or sleeve 640 which provides a fluid passage from second container 620 to a fluid dispensing device 650. Fluid dispensing device 650 may further include a cap mechanism or fluid port 660 which provides for the selective dispensing of fluids contained in primary chamber 610 and/or second container 620.

In one embodiment, as shown in FIG. 6B, second container 620 is inserted through an opening in the bottom of primary container 610 to access the cavity. In this embodiment, an end cap 645 is pressed, slid, twisted, snapped or screwed onto the bottom most portion of container 610. In one embodiment, chamber 610 comprises a fluid sealed chamber 610 even absent end cap 645. End cap 645 may comprise a generally solid endplate 635 with a biasing member 655. Again, biasing member 655 may comprise a spring or other resilient material adapted to bias second container 620 towards sealing mechanism 630. Further, biasing member 655 may nestle within a concave bottom of second container 620.

A similar but alternative system 670 is depicted in FIG. 6C. System 670 has similar features as system 600, including primary chamber 610, second container 620, sealing mechanism 630, and channel 640 for transferring fluid to a fluid dispensing device 650 and fluid port 660. In this embodiment, however, end cap 645 comprises a slideable end cap having biasing member 655 disposed on a portion thereof. End cap 645 includes outer fingers 672 and inner fingers 634 which are spaced apart from one another and adapted to receive a lower finger 676 coupled to the bottom of primary chamber 610. As shown in FIG. 6C, lower finger 676 is nestled between inner fingers 674 and outer fingers 672 to help couple end cap 645 to primary chamber 610. Again, fingers 672, 674, and 676, may comprise individual fingers, arc-shaped fingers, or ring-shaped fingers extending around a portion or the entire opening into the primary chamber cavity.

In conjunction with FIGS. 7A–7F, a fluid dispensing device 700 according to the present invention will be described. Device 700 includes a cap 710, which may comprise a snap-on or screw-on cap 710 adapted to couple to a top of a primary chamber as previously discussed by not shown in FIGS. 7A–7F. Cap 710 has an opening 712, which may be a cylindrical opening 712 defined by a cylindrical ring 714 vertically extending from an upper surface of cap 710. Other shaped openings 712 also fall within the scope of the present invention, and will depend in part on the shape of ring 714. Opening 712 is of sufficient size for a fluid port system 720 to be disposed therein. Fluid port 720 includes a cavity 728 defined between an outer wall 724 and a central post 722. Fluid port 720 may further comprise one or more ribs 726 near the top of outer wall 724 to provide a rigid structure between outer wall 724 and central post 722. In one embodiment, however, cavity 728 is a single cavity below ribs 726 as can be seen in FIG. 7F.

Figure 7A:
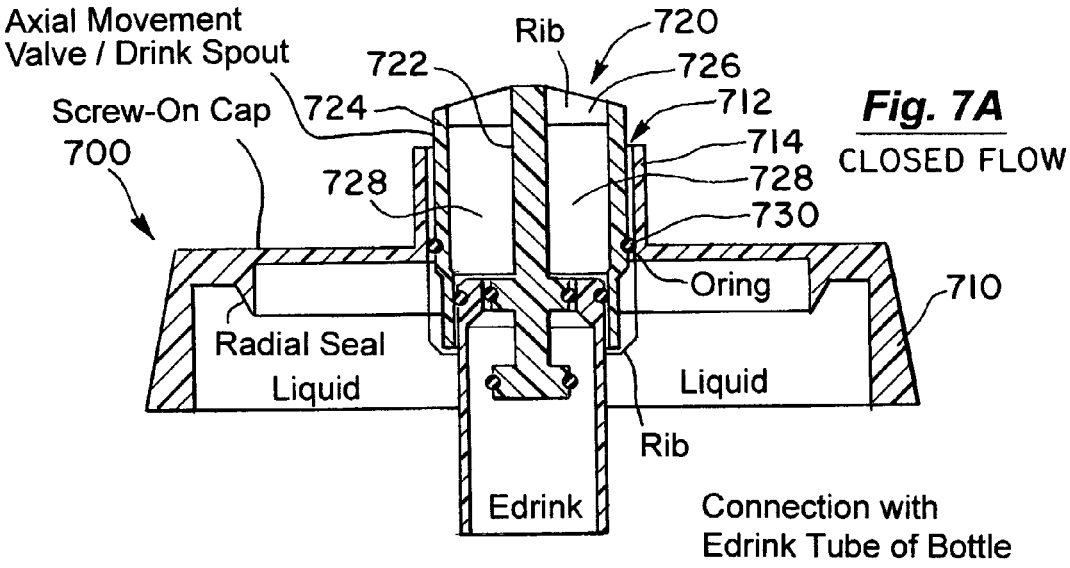
FIGS. 7A–7C are cross-sectional side views of a fluid dispensing device for use with various embodiments of the present invention.
Figure 7B:
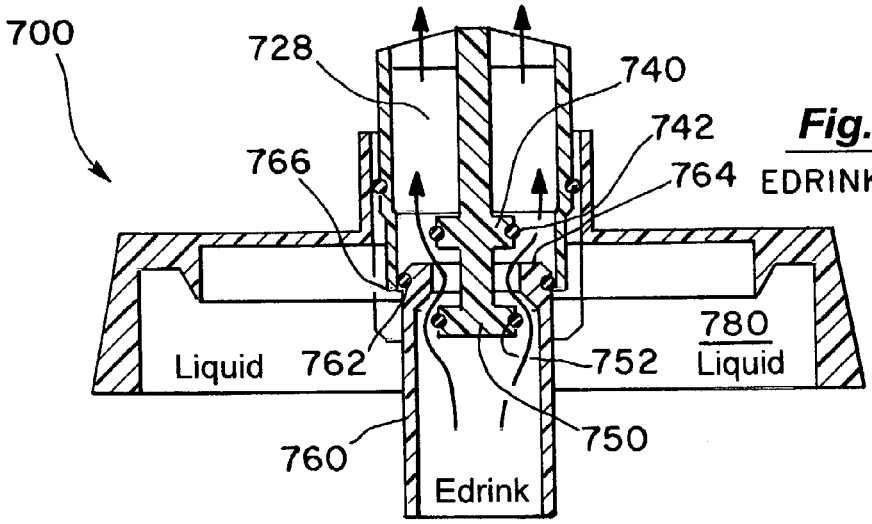
Figure 7C:
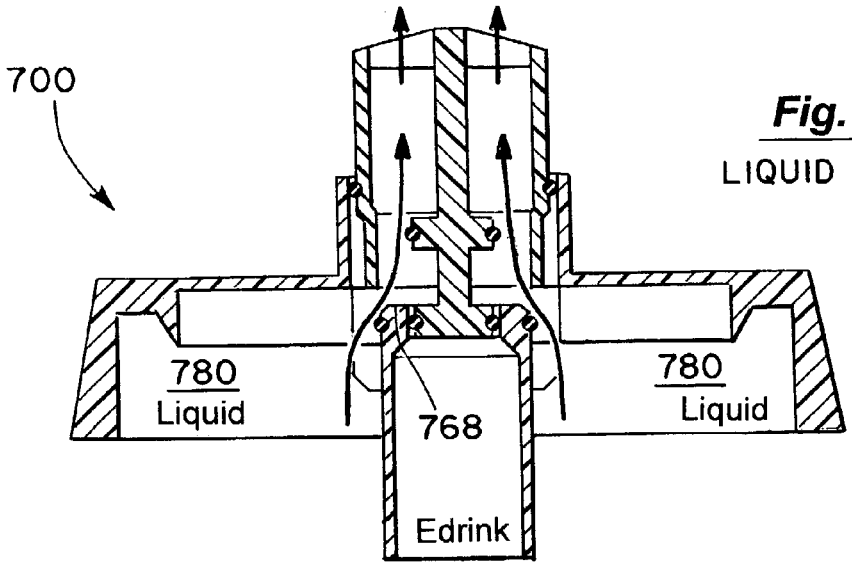

Central post 722 is coupled to or formed with a first extension 740 and a second extension 750 as best seen in FIGS. 7A–7C. First extension 740 has an O-ring 742 disposed around the circumference thereof. Similarly, second extension 750 has an O-ring 752 disposed around the circumference thereof. Further, fluid port 720 has a primary O-ring 730 extending around an outer surface of outer wall 724 and mating to an inner wall defined by cylindrical ring 714. As can be shown in FIGS. 7A–7C, the operation of fluid port 720 causes O-ring 730 to slide up and down along and between the inner surface of cylindrical ring 714 and the outer surface of outer wall 724. In this manner, primary O-ring 730 provides a fluid seal therebetween so that liquid contained within a primary chamber 780 does not leak out past fluid port 720. Fluid port 720 is in a closed position in FIG. 7A.

Fluid dispensing device 700 further includes a cavity 770 which is coupled to a second container such as an energy drink container. Cavity 770 has a wall 760 extending through at least a portion of primary chamber 780. An O-ring 762 is disposed around the circumference of wall 760 near an upper surface 768 thereof. As shown in FIG. 7B, O-ring 762 engages an inner surface of outer wall 724 to provide a fluid seal therebetween. In this embodiment, when fluid port 720 is extended upward as shown in FIG. 7B, O-ring 762 operates to maintain a fluid seal for primary chamber 780. Further, primary O-ring 730 operates to fluidly seal the upper portion of primary chamber 780 as previously discussed. In this manner, the position of fluid port 720 in FIG. 7B fluidly seals a liquid in primary chamber 780. As previously discussed, in one embodiment this liquid is a hydrating liquid such as water, Gatorade®, Accelerade®, or other electrolyte-containing beverages.

As can be seen in FIG. 7B, extending fluid port 720 upward releases O-ring 742 from inner surface 764 of wall 760. Further, the position shown in FIG. 7B has not extended fluid port 720 a sufficient amount to cause second extension 750 to engage inner wall 764. Thus, a fluid flow path is provided, as shown by the arrows in FIG. 7B, from second container 770 up into cavity 728. In this manner, the user has access to fluid held in container 770.

Figure 7D:
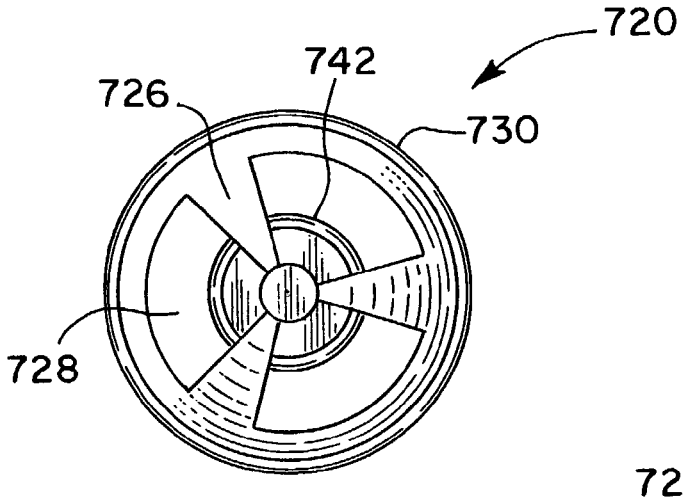
FIGS. 7D–7F are top, side and overall views, respectively, of a fluid port used with the embodiment shown in FIGS. 7A–7C.
Figure 7F:
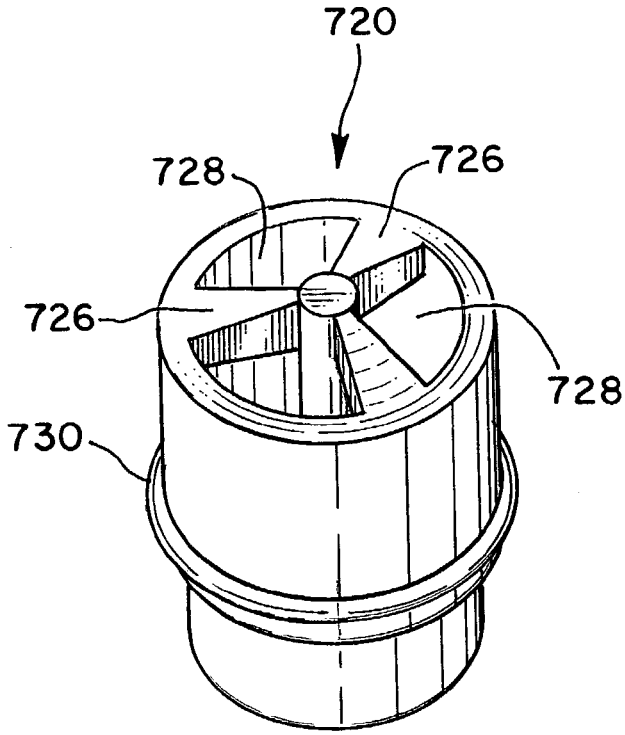
Figure 7E:
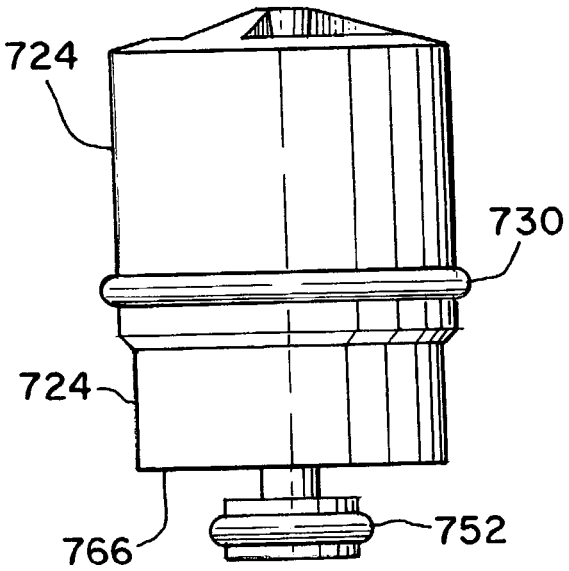

Fluid port 720 is further extendable to the position as shown in FIG. 7C. In this case, bottom extension 750, and more particularly O-ring 752, engages inner surface 764 to form a fluid seal therebetween. However, a bottom edge 766 of outer wall 724 has been raised a sufficient amount to clear the upper surface 768 of sleeve 760. As shown in FIG. 7C, a fluid path now occurs between primary chamber 780 and cavity 728. In this manner, the user has access to a liquid or beverage held in primary chamber 780. Thus, as shown in FIGS. 7A–7C, fluid dispensing device 700 provides access to one or both fluids contained within fluid dispensing systems according to the present invention. FIGS. 7D–7F provide further views of fluid port 720 as previously described.

Figure 8B:
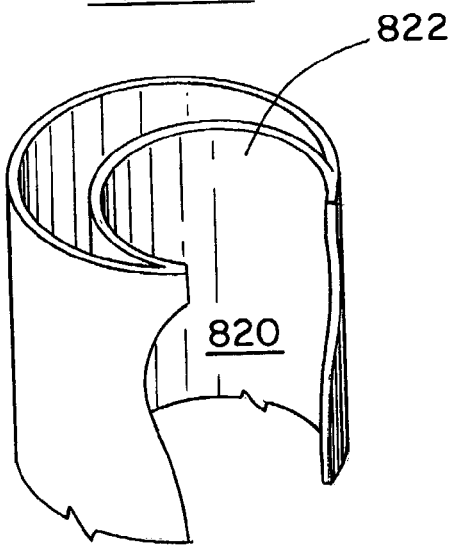
FIG. 8B is a simplified overall view of a portion of the fluid dispensing system of FIG. 8A absent the cap and second beverage container.
Figure 8A:
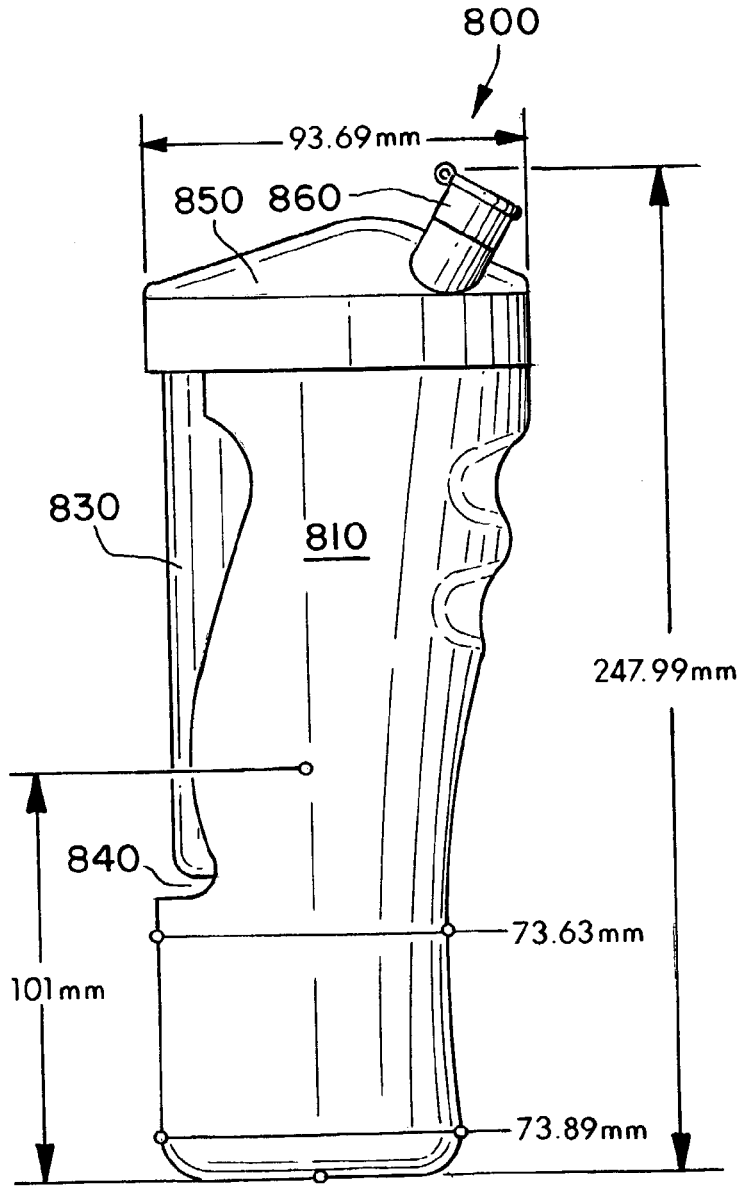
FIG. 8A is a side view of another embodiment of a beverage dispensing system according to the present invention.

Turning now to FIGS. 8A–8B, an alternative embodiment of a fluid dispensing device 800 according to the present invention will be described. As with similar embodiments, dispensing device 800 includes a primary chamber 810 defining a cavity 820 formed therein which is adapted to receive a second container 830. In one embodiment, while primary chamber 810 has greater length, height, width, and/or diameter than second container 830, the formation of cavity 820 therein results in second container 830 having a greater volume for holding fluid than does primary chamber 810. In another embodiment, the volume of containers 810 and 830 are about the same. In still another embodiment, the volume of chamber 810 exceeds that of container 830, notwithstanding cavity 820 formed within primary chamber 810.

As shown in FIG. 8A, a gap 840 may exist at the bottom of cavity 820 after the insertion of second container 830 therein. Gap 840 may be filled or partially filled with a biasing member as discussed in conjunction with previous embodiments. Alternatively, gap 840 may be left open in the event that the sealing mechanism attached to the top of second container 830 is of sufficient strength to maintain a fluid seal between the sealing mechanism and second container 830. Further, gap 840 may be used to accommodate larger or longer second containers 830 than the one depicted in FIG. 8A.

In one particular embodiment, a sealing mechanism 850 couples to primary chamber 810 to fluidly seal the upper portion of chamber 810. Sealing mechanism 850 in this embodiment further doubles as a cap mechanism 850. As shown in FIG. 8B, cavity 820 extends to an upper surface 822 of primary container 810. Second container 830 slides into cavity 820, after which a user would affix cap 850 thereto. Thus, cap 850 provides a fluid seal over both primary chamber 810 and second container 830. Cap 850 further includes a fluid port 860, which again may be a rotatable or translatable fluid port to selectively dispense fluids from primary chamber 810 and/or second container 830.

FIG. 8A depicts various dimensions for a particular embodiment of the present invention. However, it will be appreciated by those skilled in the art that these dimensions are not intended to be limiting and represent only one of a variety of sized vessels or devices 800 according to the present invention.

Figure 9A:
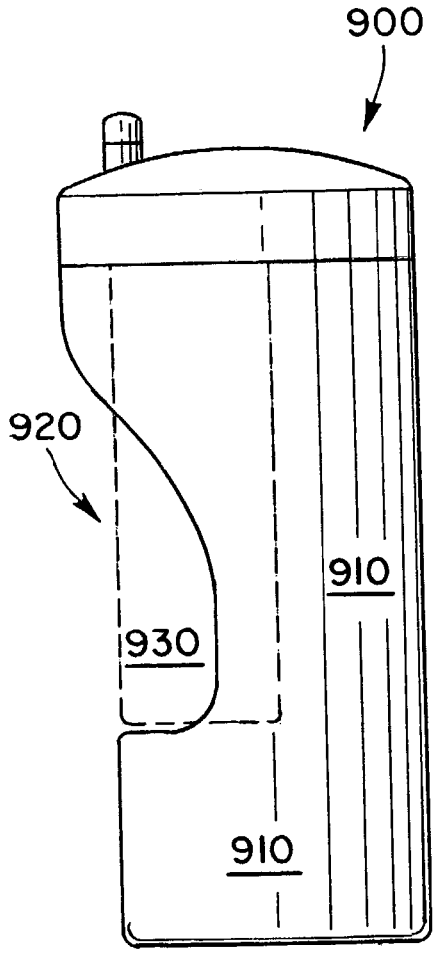
FIGS. 9A and 9B are a simplified side view and exploded view, respectively, of a beverage dispensing device according to an embodiment of the present invention.
Figure 9B:
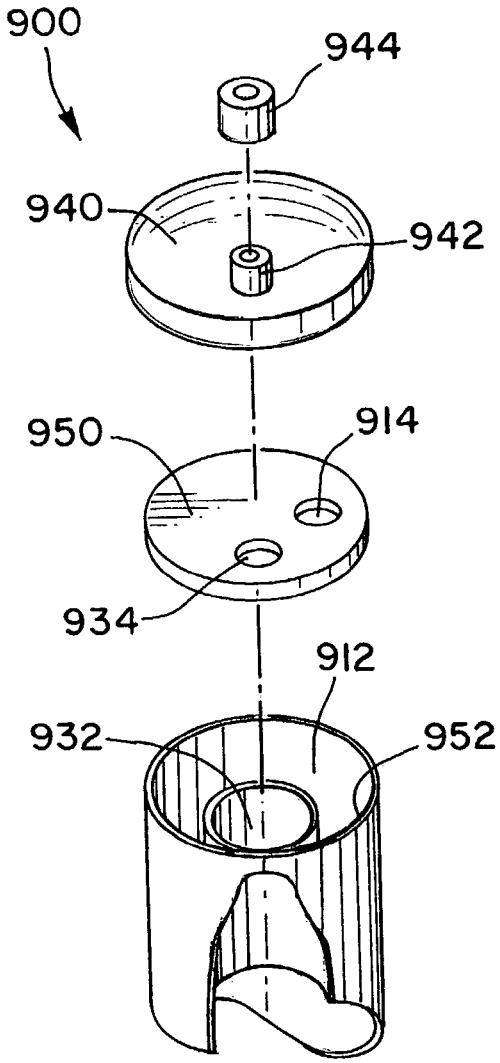

Turning now to FIGS. 9A–9B, an alternative embodiment of a fluid dispensing device 900 according to the present invention will be described. Device 900 again includes a primary container 910 having a cavity 920 formed therein. Cavity 920 is adapted to receive a second container 930. Preferably, second container 930 contains a beverage, and in a particular embodiment primary container 910 contains a different beverage. Alternatively, containers 910 and 930 could contain the same beverage. In still another embodiment, second container 930 may comprise ice or a frozen beverage. In this manner, second container helps cool or keep cool a liquid in primary chamber 920. In an alternative embodiment, primary container 910 contains ice or a frozen beverage, and is used to help cool or keep cool a liquid in second container 930.

Device 900 includes a cap system designed to provide selectable access to one or both liquids. As shown in FIG. 9B, primary container 910 defines a chamber 912 for holding a first liquid, and second container 930 has a chamber 932 for holding a second liquid. An inner cap 950, which in this embodiment is a snap-fit cap 950, is placed over chambers 912 and 932 such that the outer edge of inner cap 950 slides inside an upper lip 952 of primary container 910. Inner cap 950 includes a first fluid port 914 and a second fluid port 934 disposed therethrough. Fluid ports 914 and 934 are aligned over chambers 912 and 932 to provide fluid access thereto. An upper cap 940 is then placed over inner cap 950, with the inner edge of upper cap 940 sliding outside or over primary container edge 952. Further, inner cap 950 may include one or more O-rings to help fluidly seal the upper portion of primary container 910.

Upper cap 940 is rotatable relative to inner cap 950. In this manner, a primary fluid port 942 may be aligned with either fluid port 914 or fluid port 934. In this manner, by rotating upper cap 940 to align fluid port 942 with second fluid port 934, a user will have access to the beverage contained within second chamber 932. Similarly, aligning fluid port 942 with first fluid port 914 allows the user to access the beverage held in chamber 912. An extension plug 944 is disposed over fluid port 942 to permit fluid to flow through fluid port 942 or to seal fluid port 942, as is known in the art. In this manner, fluid dispensing device 900 provides for the storage and selective dispensing of two or more fluids.

Figure 10A:
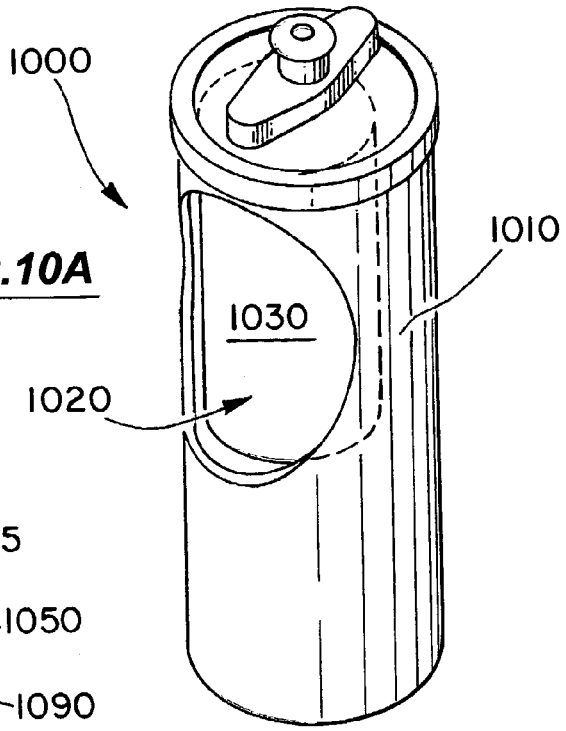
Figure 10B:
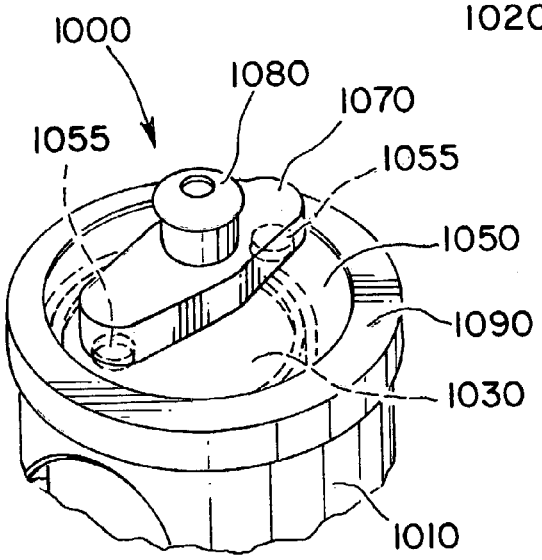
Figure 10C:
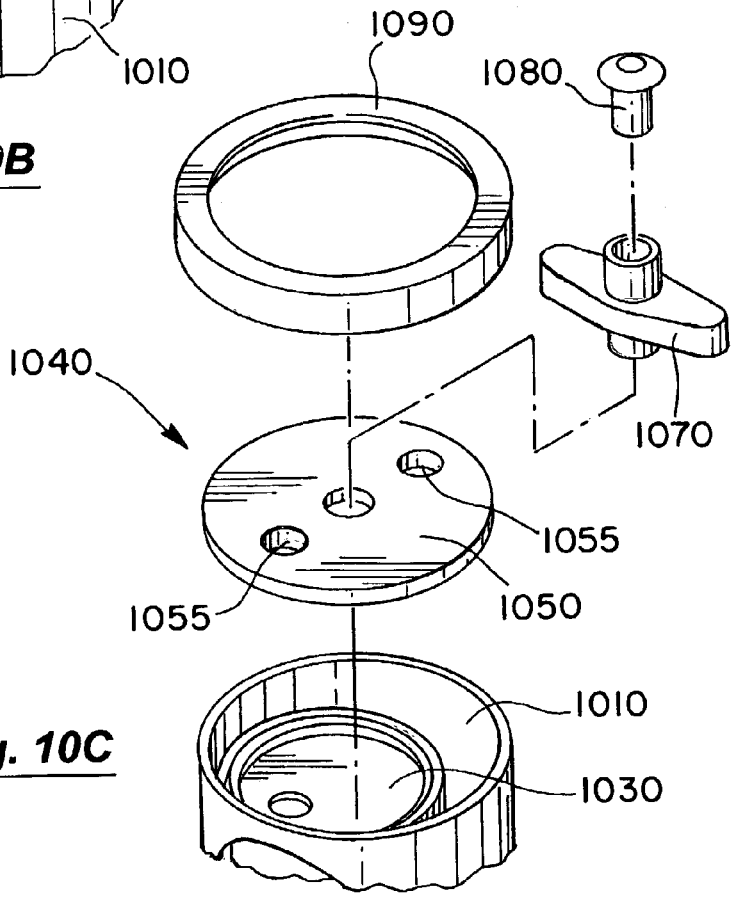

Turning now to FIGS. 10A–10C, an alternative fluid dispensing system 1000 of the present invention will be described. Fluid dispensing system 1000 includes a primary container 1010 defining a cavity 1020 disposed therein. Cavity 1020 is adapted to receive a second container 1030, which again in one embodiment is a container of an energy drink. System 1000 further includes a fluid dispensing device 1040, as best seen in FIG. 10C. Dispensing device 1040 includes a sealing ring 1050 having an inverted T-shaped port 1070 rotatably coupled thereto. Port 1070 has fluid channels which, when port 1070 is rotated, are adapted to align with openings 1055. In one embodiment, one opening 1055 is disposed over primary container 1010 while the second opening 1055 is disposed over second container 1030. A pull plug 1080 is included to provide access to fluids within device 1010. An outer ring 1090 helps secure dispensing device 1040 to system 1000.

FIGS. 11A–11C depict an alternative embodiment of a fluid dispensing device 1100 according to the present invention. While similar to other embodiments described herein, device 1100 further includes an air hole 1150 which is adapted to permit air to pass into a cap mechanism 1140. In this manner, air hole 1150 allows air to enter a primary chamber 1110 and/or a second container 1120 to replace fluid which may be drawn through cap mechanism 1140. This feature also may be included in alternative embodiments of the present invention discussed herein.

Figure 12A:
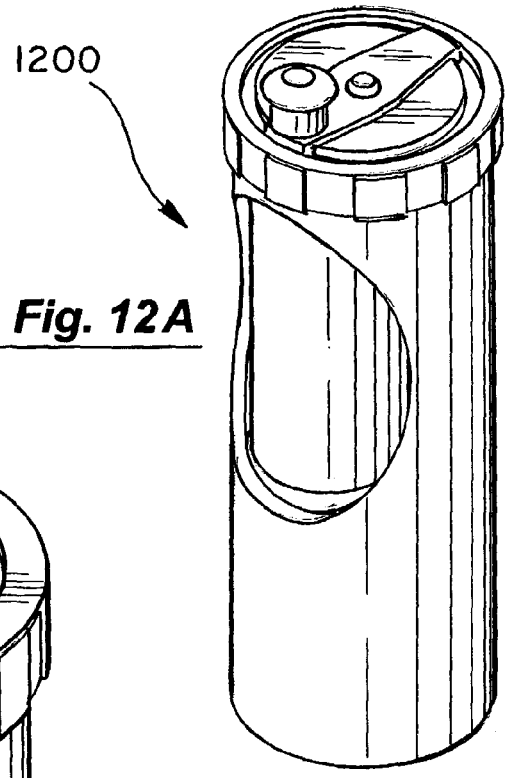
Figure 12B:
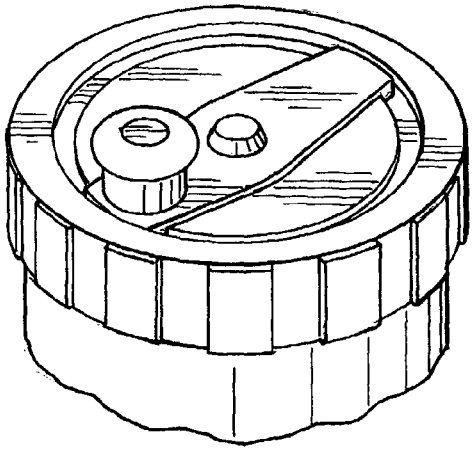
Figure 12C:
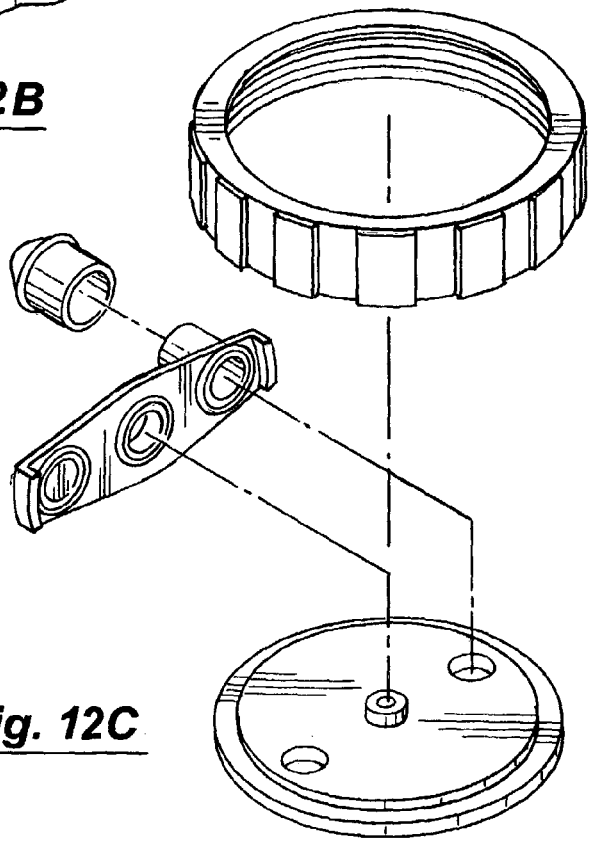

Still another embodiment of a fluid dispensing device 1200 according to the present invention is described in conjunction with FIGS. 12A–12C. Device 1200 includes numerous features similar to those previously described. However, fluid dispensing system 1200 has a ridged outer ring to facilitate its use. Further, the cap system includes a rotatable fluid port which may be aligned above the primary container or second container in system 1200.

Figure 13:
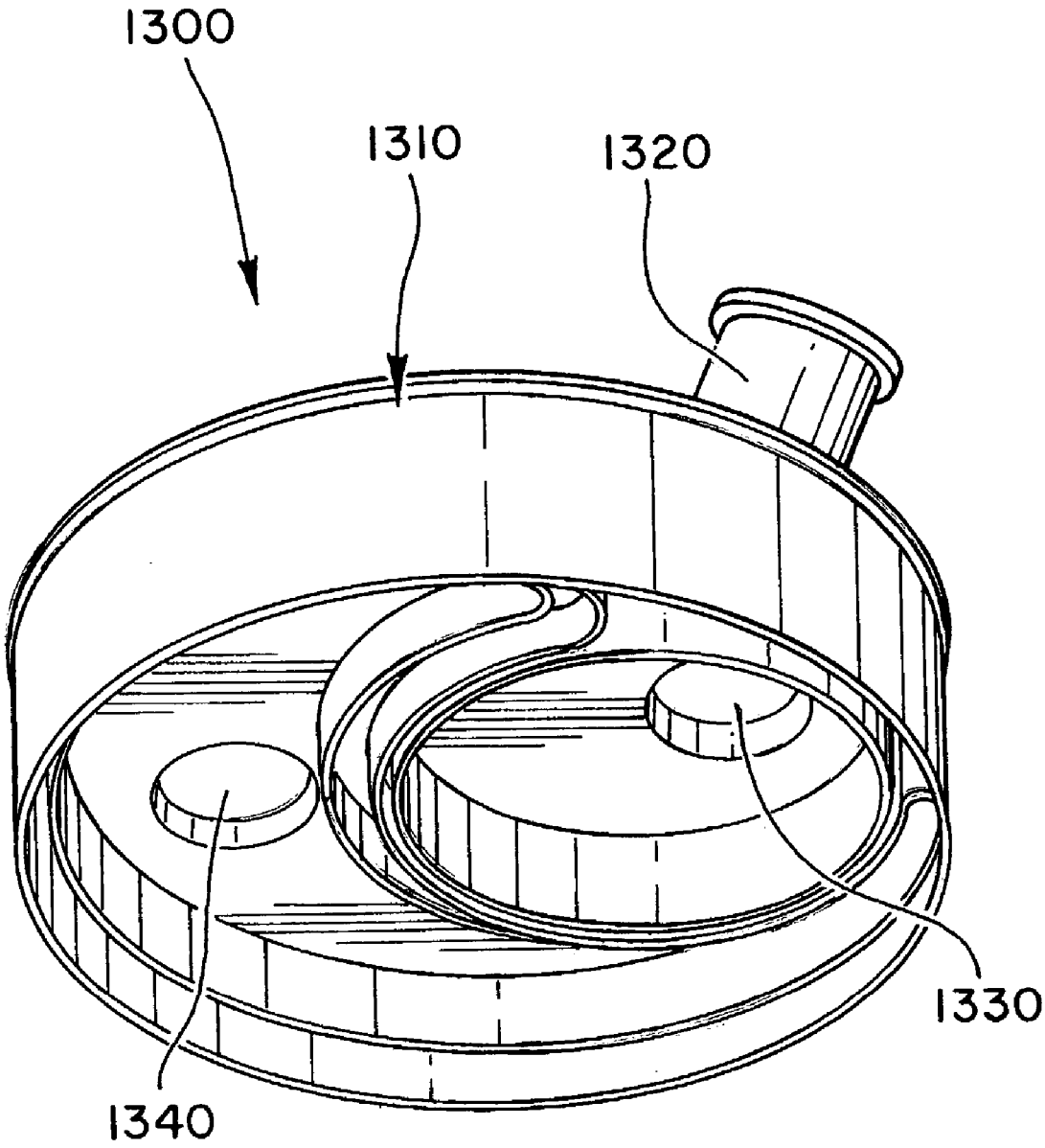
FIG. 13 is an overall view of an underside of a beverage dispensing device or lid according to the present invention.

FIG. 13 depicts an alternative sealing mechanism 1300 according to the present invention. FIG. 13 shows an upper cap 1310 and a fluid port 1320 having an inner surface adapted to be disposed over the top of a second container (not shown). Again, fluid port 1320 may be rotatable to align fluid port 1320 with an opening 1330 which extends toward a second container or an opening 1340 which opens into a primary container. This sealing mechanism 1300 may be used, for example, with the embodiment further detailed in FIGS. 8A–8B or FIGS. 9A–9B.

Figure 14:
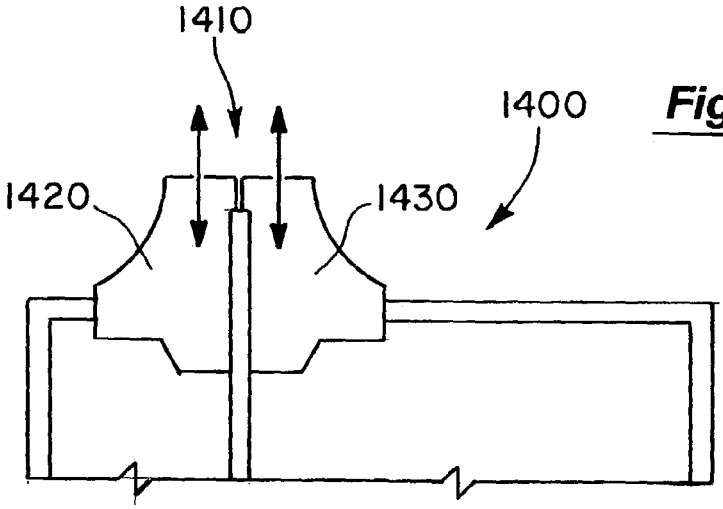
FIG. 14 is an alternative embodiment of a beverage dispensing device according to the present invention.

FIG. 14 depicts an alternative fluid dispensing device 1400 for use with embodiments of the present invention. Device 1400 includes a fluid port 1410 having first and second halves 1420 and 1430. Halves 1420, 1430 may be raised to provide access to fluid contained within the lower chambers. In this particular embodiment, raising both haves 1420 and 1430 will allow fluid access to both chambers simultaneously. This may be desirable, for example, if an athlete or person exercising wishes to consume both beverages at the same time, with perhaps the rapid consumption being more important than the taste of either beverage.

Figure 15A:
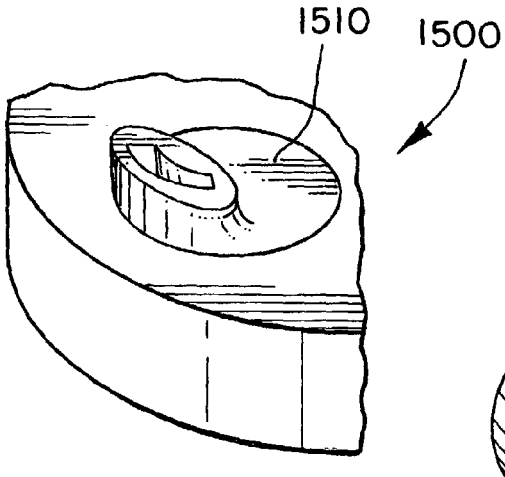
FIGS. 15A–15B are simplified overall views of a beverage dispensing device according to the present invention.
Figure 15B:
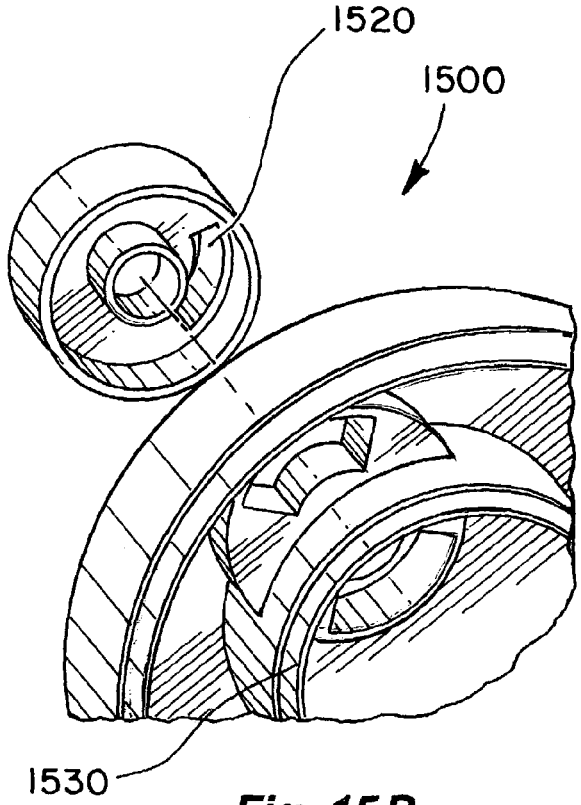

FIGS. 15A and 15B depict an alternative embodiment of a fluid dispensing device 1500 for use with embodiments of the present invention. Device 1500 involves a rotatable fluid port 1510 having an arc-shaped opening 1520 thereto. Opening 1520 may be aligned, as shown in FIG. 5B, with fluid contained in either of the lower chambers. In an alternative embodiment, arc-shaped opening 1520 is aligned with both chambers simultaneously. This may occur, for example, by having a hole in the upper cap portion which spins an inner ridge 1530 dividing the primary chamber from the second chamber.

FIGS. 16A–16C depict alternative embodiments of beverage dispensing systems 1600 according to the present invention. In the embodiment shown in FIG. 16A, a primary container 1610 has a fluid port 1620 coupled thereto for dispensing a fluid which may, or may not, reside in primary container 1610. Fluid port 1620 may be angled similar to that shown, or straight. Primary container 1610 has a cavity 1630 formed therein which is adapted to receive a second container 1640. FIGS. 16A and 16C depict two cavities 1630 having different alignments, although the present invention may include further alignments, dimensions and positions of cavity 1630 than those shown. Returning to FIG. 16A, second container 1640 has a fluid port 1650 for dispensing a fluid therefrom. In one embodiment, fluid port 1650 is a standard pull top or pull tab common to many pop cans, energy drink cans, and the like. Primary container 1610 further includes an overhang region 1660 which may help maintain second container 1640 within cavity 1630. It will be appreciated by those skilled in the art that while both primary container 1610, overhang 1660, and second container 1640 all are shown as curved or cylindrical components, alternative shapes may be used within the scope of the present invention. In the embodiment shown in FIG. 16A, both beverages may be selectively dispensed from the upper surface of system 1600 according to the desires of the user. Further, the system shown in FIG. 16A may have dimensions and weight which permit system 1600 to be vended from standard vending equipment.

In the embodiment shown in FIG. 16C, cavity 1630 accommodates an angled position of second container 1640. This may, in one embodiment, facilitate ease of access to fluid contained within second container 1640. Either embodiment shown in FIG. 16A or 16C may further include a sealing mechanism 1670, such as those described in conjunction with earlier figures including FIGS. 2A–2D. In this manner, second container 1640 may be selectively sealed, opened and resealed. In one embodiment, sealing mechanism 1670 may be snapped, flipped or otherwise rotated on and off of the upper surface or rim of second container 1640. In another embodiment sealing mechanism 1670 is hingedly or rotatably attached to second container 1640, or attached thereto by another means. Further, the embodiments shown in FIG. 16A–16C facilitate ease of replacement of second container 1640, such as when the user has finished consuming an energy drink and wishes to insert a new drink container 1640 into cavity 1630. While FIG. 16A depicts overhang 1660, which helps hold container 1640 within cavity 1630, other retaining mechanisms may be used. For example, cavity 1630 may be formed with tolerances designed to provide a pressure fit of second container 1640 within cavity 1630.

While numerous features of the present invention have been described in conjunction with particular embodiments and/or particular Figures, it will be appreciated by those skilled in the art that many of these features may find use in the various embodiments of the present invention. For example, while the biasing member was described primarily in conjunction with FIGS. 5A–5C, this biasing member may find use in other embodiments. Further, while the extension members 560 were described in conjunction with FIGS. 5A–5C, they also may be used in conjunction with alternative embodiments of the present invention. Similarly, the air vent described in conjunction with FIGS. 11A–11C may be used with alternative embodiments of the present invention as may the sealing mechanisms described in conjunction with FIGS. 2A–2C. Further, the fluid dispensing systems described in conjunction with FIGS. 13–15B may find use in the various embodiments of the present invention.

Thus, notwithstanding the above description, it should be recognized that many other systems, functions, methods, and combinations thereof are possible in accordance with the present invention. Although the invention is described with reference to specific embodiments and figures thereof, the embodiments and figures are merely illustrative, and not limiting of the invention. Rather, the scope of the invention is to be determined solely by the appended claims.

What is claimed is:

1. A beverage dispensing container, comprising:

a primary chamber for holding a first liquid;

a fluid dispensing device coupled to the primary chamber, the fluid dispensing device adapted to provide access to the primary chamber when in a first position and adapted to fluidly seal the primary chamber when in a second position;

the primary chamber further defining a cavity adapted to receive a second container therein, the second container holding a second liquid in a second chamber, the second container having a fluid port adapted to be opened to provide fluid access to the second chamber; and a sealing mechanism adapted to fluidly seal the fluid port when the second container is disposed in the cavity;

wherein the sealing mechanism is further adapted to permit removal of the second container from the cavity and reinsertion of the second container into the cavity to fluidly reseal the open fluid port;

wherein the primary container further comprises an inner extension, and wherein the inner extension extends into the cavity when an outer surface of the primary container is compressed.

2. The beverage dispensing container as in claim 1 wherein the inner extension is adapted to at least partially compress the second container when the outer surface of the primary container is compressed.

3. The beverage dispensing container as in claim 1 wherein the inner extension comprises an inner surface of the primary container.

4. A beverage dispensing container, comprising:

a primary chamber for holding a first liquid;

a fluid dispensing device coupled to the primary chamber, the fluid dispensing device adapted to provide access to the primary chamber when in a first position and adapted to fluidly seal the primary chamber when in a second position;

the primary chamber further defining a cavity adapted to receive a second container therein, the second container holding a second liquid in a second chamber, the second container having a fluid port adapted to be opened to provide fluid access to the second chamber; and a sealing mechanism adapted to fluidly seal the fluid port when the second container is disposed in the cavity;

wherein the sealing mechanism is further adapted to permit removal of the second container from the cavity and reinsertion of the second container into the cavity to fluidly reseal the open fluid port;

wherein the fluid dispensing device is further coupled to the sealing mechanism so that the second liquid is selectively dispensed through the fluid dispensing device when the fluid dispensing device is positioned in a third position.

5. The beverage dispensing container as in claim 4 wherein at least a portion of the fluid dispensing device is adapted to move relative to the primary chamber to be positioned in the first, second and third positions.

6. The beverage dispensing container as in claim 4 wherein the fluid dispensing device further comprises a fluid port that is adapted to be positioned in the first, second and third positions.

7. A beverage dispensing system, comprising:

a primary chamber for holding a first liquid, the primary chamber defining a cavity therein;

a second container adapted to be disposed in the cavity, the second container for holding a second liquid in a second chamber, the second container having a fluid port adapted to be opened to provide fluid access to the second chamber;

a sealing mechanism positioned near an end of the cavity, the sealing mechanism adapted to receive at least a portion of the second container having the fluid port when the second container is disposed in the cavity; and a fluid dispensing device coupled to the primary chamber and to the sealing mechanism, the fluid dispensing device adapted to provide selectable access to the primary chamber and the second chamber.

8. The beverage dispensing system as in claim 7 wherein the sealing mechanism is further adapted to permit removal of the second container from the cavity and reinsertion of the second container into the cavity to fluidly reseal the open fluid port.

9. The beverage dispensing system as in claim 7 wherein the second liquid comprises an energy drink and the second container is a generally cylindrical container adapted to hold between about 8.2 fluid ounces and about 8.5 fluid ounces of the second liquid.

10. The beverage dispensing system as in claim 7 further comprising a biasing member adapted to engage the second container and bias the second container towards the sealing mechanism.

11. The beverage dispensing system as in claim 10 wherein the biasing member is integrally formed with the primary chamber.

* * * * *